US006032605A

United States Patent [19]

Takashima

[11] Patent Number: 6,032,605

[45] Date of Patent: Mar. 7, 2000

[54] ADJUSTABLE SPONSON SYSTEM FOR WATERCRAFT

[75] Inventor: Sumihiro Takashima, Shizuoka, Japan

[73] Assignee: Yamaha Hatsudoki Kabushiki Kaisha, Japan

[21] Appl. No.: 08/988,245

[22] Filed: Dec. 1, 1997

[30] Foreign Application Priority Data

Nov. 29, 1996 [JP] Japan ..... 8-359800

[51] Int. Cl.[7] ..... B63B 1/22

[52] U.S. Cl. ..... 114/284; 114/55.5; 114/343; 114/123

[58] Field of Search ..... 114/55.5, 55.52, 114/55.53, 55.54, 55.55, 55.56, 55.57, 55.58, 271, 280, 283, 284, 292

[56] References Cited

U.S. PATENT DOCUMENTS

| | | | |
|---|---|---|---|
| 1,075,726 | 10/1913 | Prosser . | |
| 2,832,304 | 4/1958 | Elyosius et al. . | |
| 2,919,669 | 1/1960 | Kikuhara . | |
| 3,106,178 | 10/1963 | Cale . | |
| 3,115,860 | 12/1963 | Payne | 114/123 |
| 3,159,131 | 12/1964 | Frederick | 114/285 |
| 3,481,297 | 12/1969 | Mantle . | |
| 4,320,713 | 3/1982 | Nishida et al. | 114/123 |
| 4,458,622 | 7/1984 | Anderson | 114/284 |
| 4,909,176 | 3/1990 | Kobayashi | 114/343 |
| 5,313,907 | 5/1994 | Hodges | 114/290 |
| 5,713,297 | 2/1998 | Tani et al. | 114/284 |

FOREIGN PATENT DOCUMENTS

| | | | |
|---|---|---|---|
| 84 19306 | 6/1986 | European Pat. Off. . | |
| 357644 | 6/1921 | Germany | 114/126 |
| 5-238476 | 9/1993 | Japan . | |
| 6-191466 | 7/1994 | Japan | 114/271 |

OTHER PUBLICATIONS

McKercher. "Getting A Handle" article, *Personal Watercraft Illustrated*, vol. 9, No. 1, Jan. 1995 pp. 68–72.

"Doo–ing the Twist" advertisement, *Splash* magazine, vol. 8, No. 5, May 1995.

*Primary Examiner*—Jesus D. Sotelo

*Attorney, Agent, or Firm*—Knobbe, Martens, Olson & Bear, LLP

[57] ABSTRACT

An adjustable sponson system for a watercraft includes a coupling mechanism that allows the position of the sponsons relative to the hull of the watercraft to be varied by the operator of the watercraft while seated on the watercraft. The adjustable sponson system includes a pair of actuators which move the sponsons relative to the hull. A remotely positioned operator controls the actuator. The operator desirably is positioned on the watercraft so as to be easily operated by the rider when riding.

29 Claims, 20 Drawing Sheets

ADJUSTABLE SPONSON SYSTEM FOR WATERCRAFT

BACKGROUND OF THE INVENTION

1. Field of the Invention

The present invention relates in general to a watercraft. In particular, the present invention relates to an improved sponson design for a watercraft.

2. Description of Related Art

Personal watercraft have become very popular in recent years. An enthusiasm for competition has grown with this popularity, and as a result, personal watercraft have become increasingly faster. Many personal watercraft today are capable of traveling at speeds above 60 mph. At such speeds, however, some watercraft, especially those with modified engines, tend not to provide the stability that many riders prefer. High-performance personal watercraft also tend not to respond in a manner that many riders desire.

To improve the stability and the handling characteristics of the watercraft at high speeds, many personal watercraft now include sponsons. A sponson is an elongated rib attached to a side of the personal watercraft hull. Personal watercraft generally include a pair of sponsons which are positioned on opposite sides of the watercraft at the same position and in the same angular orientation relative to the outer chines of the watercraft hull. Some sponsons are integrally formed with the hull when the watercraft hull is molded. Other sponsons are fixed to the hull in a set position and angular orientation relative to the hull outer chines by conventional fasteners, e.g., screws.

Sponsons give a personal watercraft greater stability by creating greater hull surface area when the watercraft is up on plane. The effective hull surface area at high speeds offers greater stability and gives the rider the feeling that the personal watercraft is wider than its actual width.

The sponsons also improve the handling characteristics of the personal watercraft. The sponsons counteract the rider's shifted weight when turning, thereby allowing the rider to lean into a turn. By positioning the sponsons at points on the hull sides which lie below the water line when the watercraft is turning, the turning or handling characteristics of the watercraft also become more aggressive; a low position of the sponsons on the hull sides makes the watercraft more responsive.

The optimum placement of the sponsons on a personal watercraft varies with the rider's size, the rider's riding style, the number of riders, and riding conditions (i.e., water roughness). No perfect placement of the sponsons on the watercraft exists to maximize the stability and handling characteristics of the watercraft for every rider and under every riding condition. Previous sponson placement has been selected to produce a particular riding style, which of course does not suit every rider of the watercraft.

This problem is compounded when the watercraft is used by both single and multiple riders. Varying the number of riders gives rise to different loadings of the watercraft in a fore-and-aft direction, and the ideal position of the sponsons changes depending upon the number of riders.

SUMMARY OF THE INVENTION

The present invention involves the recognition that watercraft performance can also be enhanced by adjusting the sponsons when riding. The desired position of the sponsons when riding straight-ahead, up-on-plane, may be different than when turning. A need therefore exists for an adjustable sponson system which can be easily and readily adjusted to tailor the responsiveness and the stability of the watercraft depending upon the size and riding style of the rider, upon the number of riders, and the particular travel mode of the watercraft. In addition, a need exists for an adjustable sponson system that can be remotely adjusted by the operator when riding upon the watercraft.

One aspect of the present invention involves a watercraft comprising an upper deck and a hull. The upper deck defines at least in part a rider's area at a location between first and second sections of the hull. An adjustable sponson system includes at least first and second sponsons. Each of the first and second sponsons is movably attached to a respective one of the first and second side hull sections. At least one actuator is coupled to each sponson to move the sponson relative to the respective hull section. And at least one operator is coupled to the actuator to control the movement of at least one of the sponsons relative to the respective hull section.

Another aspect of the present invention involves a watercraft comprising an upper deck and a hull. The upper deck defines at least in part a rider's area at a location between first and second sections of the hull. An adjustable sponson system includes at least first and second sponsons, with each sponsons being movably attached to a respective one of the first and second side hull sections. At least first and second actuators are coupled to the first and second sponsons with the actuators being operable independent of each other. In this manner, a rider can control the position of each individually and can adjust the position of the sponsons separately.

An additional aspect of the present invention involves a watercraft comprising a hull and an adjustable sponson system. The adjustable sponson system includes at least one sponson that is movable attached to the hull. An operator is coupled to the sponson and is configured to control movement of the sponson relative to the hull. A motion absorbing mechanism is operable between the operator and the sponson. The motion absorbing mechanism allows the sponson to move relative to the hull under some operating conditions (e.g., when turning) without communicating such movement to the operator.

Further aspects, features, and advantages of the present invention will become apparent from the detailed description of several preferred embodiments which follows.

BRIEF DESCRIPTION OF THE DRAWINGS

The appended drawings depict several preferred embodiments which exemplify various features of the invention and which contain the following figures.

DETAILED DESCRIPTION OF PREFERRED EMBODIMENTS

The adjustable sponson system 8 of the present invention has particular utility and application for use with small watercraft such as the type commonly referred to a "personal watercraft". The following embodiments thus are illustrated in connection with an exemplary personal watercraft. The adjustable sponson system 8, however, can be used with other types of watercraft as well, such as, for example, but without limitation, small jet boats and the like.

Figure 1:
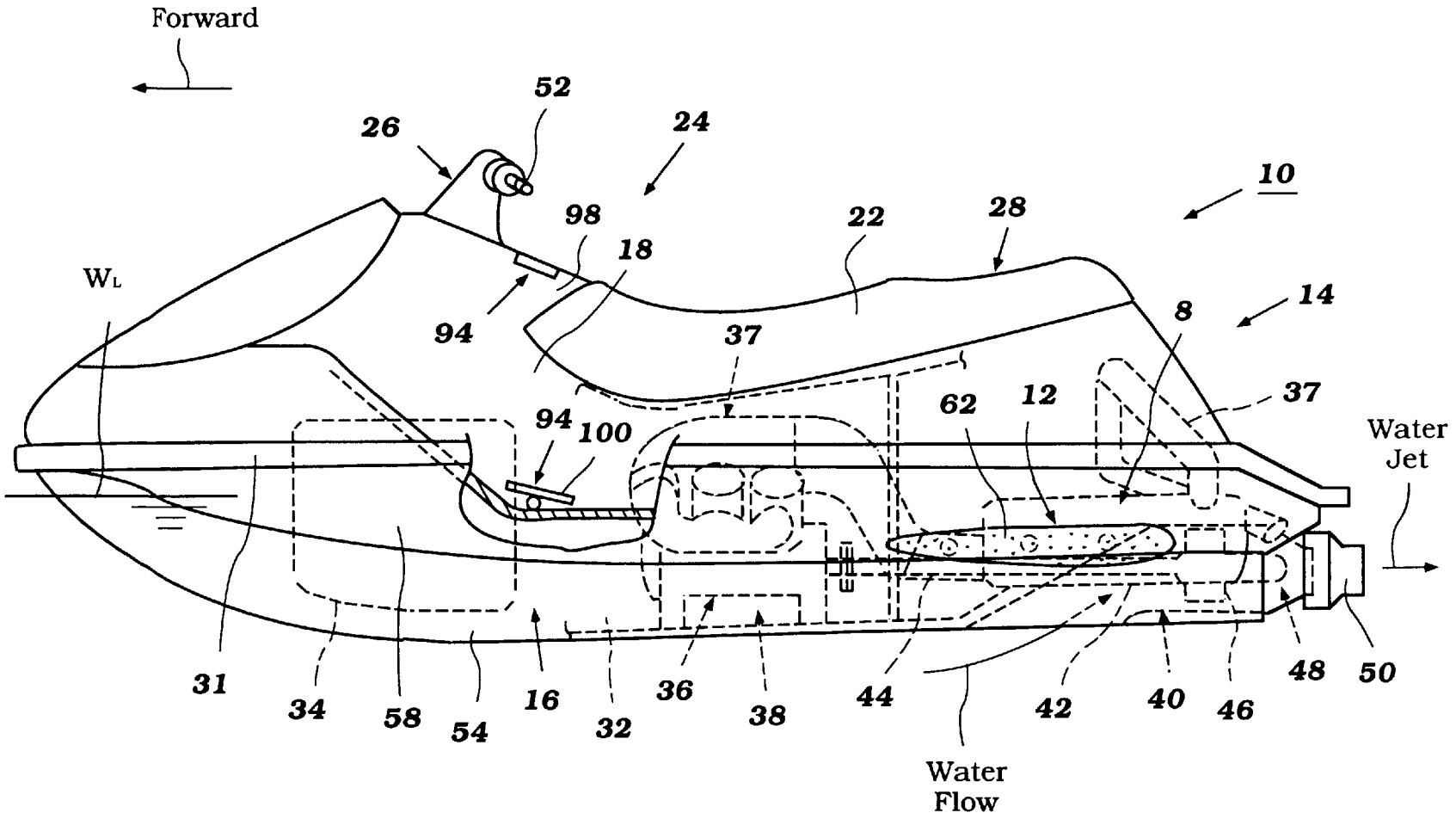
FIG. 1 is a port side elevational view of an exemplary watercraft which includes an adjustable sponson system configured in accordance with a preferred embodiment of the present invention.
Figure 2:
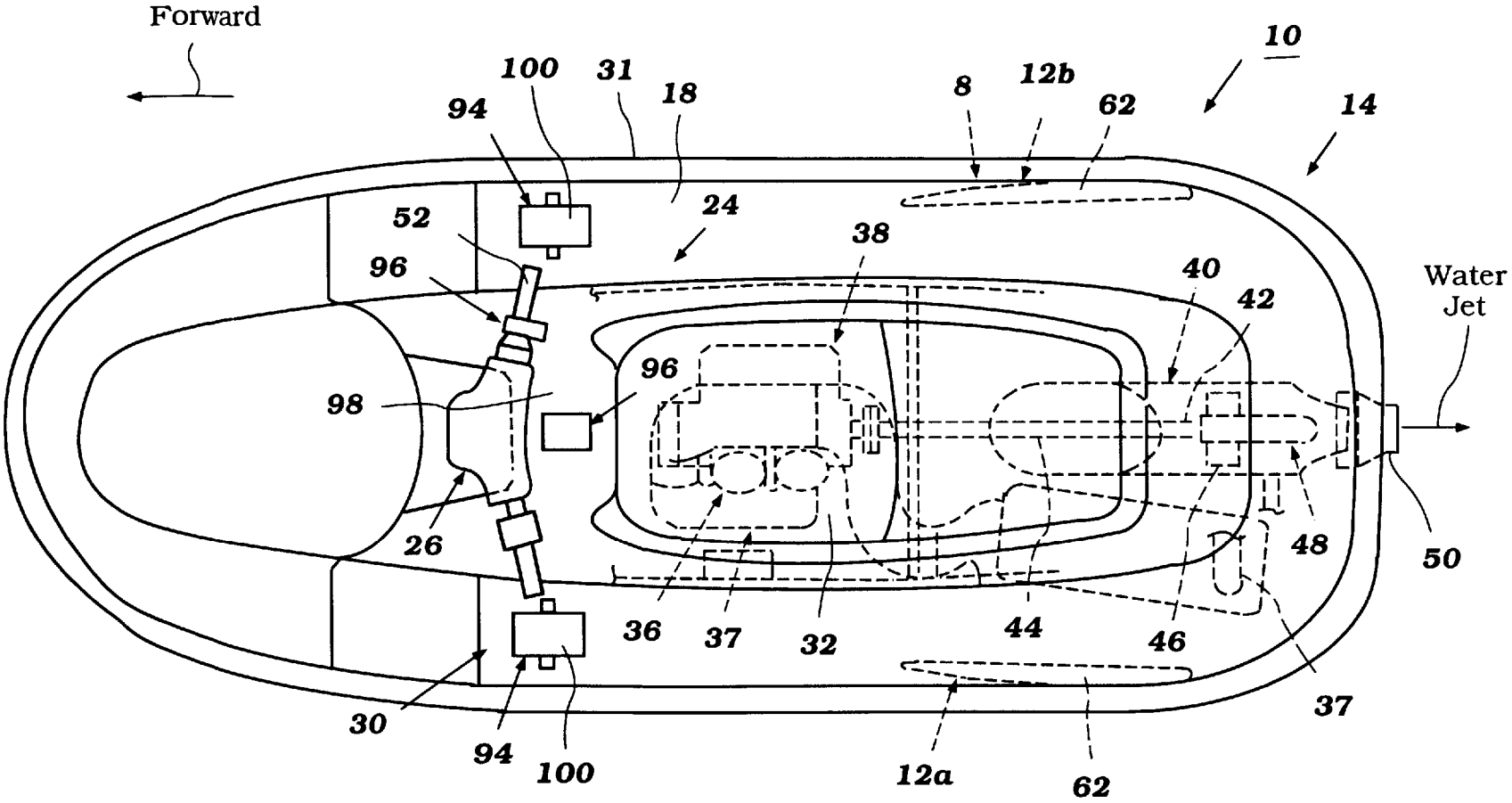
FIG. 2 is a top plan view of the watercraft of FIG. 1.
Figure 3:
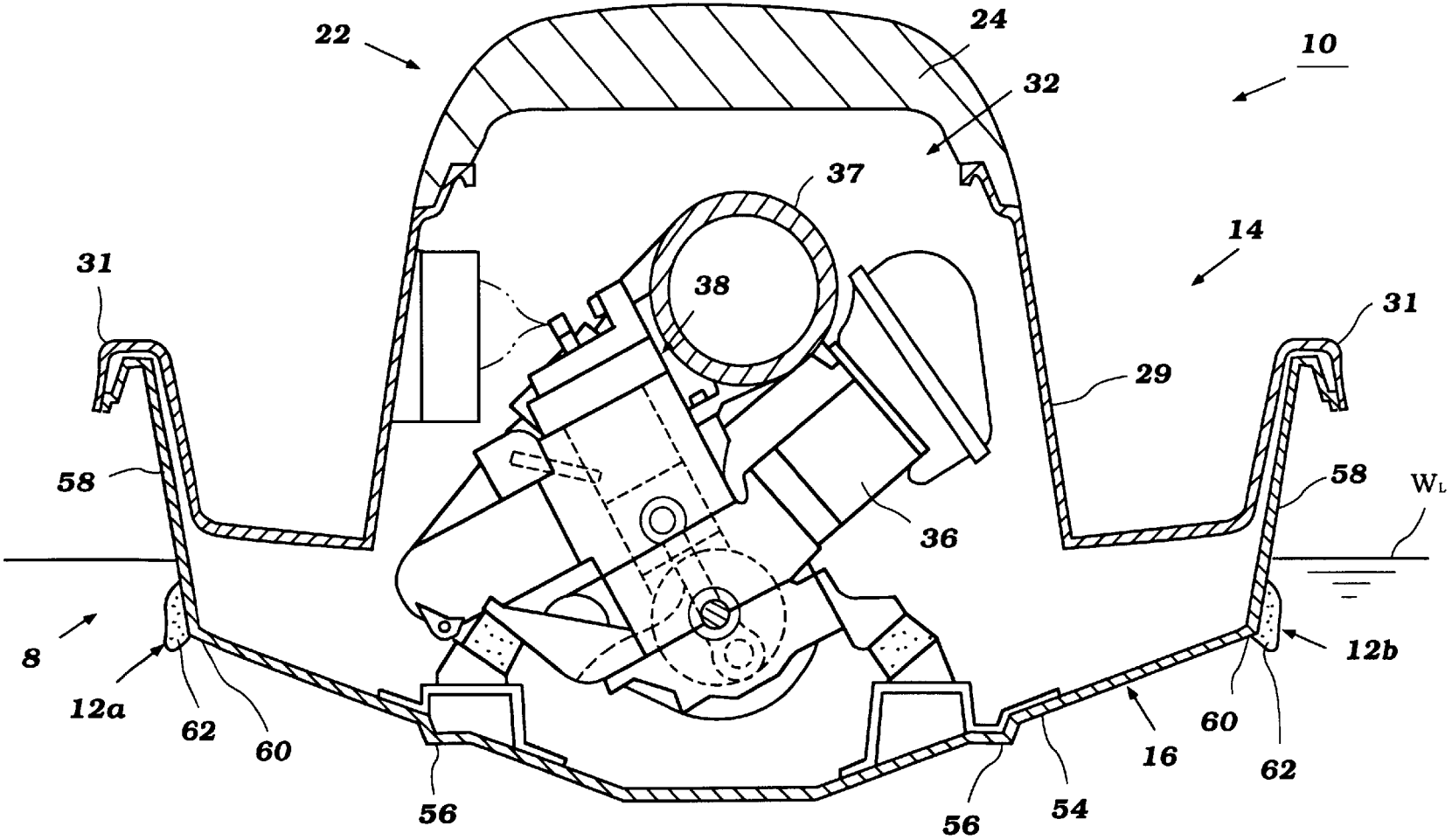
FIG. 3 is a cross-sectional view of the watercraft of FIG. 2 taken along line 3—3.

With initial reference to FIGS. 1 through 3, the personal watercraft 10 which includes a pair of adjustable sponsons 12 configured in accordance with a preferred embodiment of the present invention. Before describing the adjustable sponson system 8, an exemplary personal watercraft 10 will first be described in general details to assist the reader's understanding of the environment of use and the operation of the adjustable sponson 12. The watercraft 10 includes a hull 14 formed by a lower hull section 16 and an upper deck section 18. The hull sections 16, 18 are formed from a suitable material such as, for example, a molded fiberglass reinforced resin. The lower hull section 16 and the upper deck section 18 are fixed to each other around the peripheral edges 20 in any suitable manner.

The upper deck 18 defines a rider's area proximate to the stem of the hull 14. A passenger seat 22 is provided within the rider's area and is mounted longitudinally along the center of the watercraft 10. In the illustrated embodiment, the seat 22 has a longitudinally extended straddle-type shape which may be straddled by an operator and by at least one or two passengers. A forward end 24 of the seat 22 lies proximate to the controls 26 of the watercraft 10 which generally lie at about the longitudinal center of the watercraft 10. This position of the operator on the watercraft 10 gives the watercraft fore and aft balance when the operator rides alone. A rear portion 28 of the seat 22 is configured to allow one or two passengers to be comfortably seated behind the operator of the watercraft 10. The seat 22 desirably includes a removable seat cushion supported by a pedestal 29 to increase the comfort of the operator and the passengers.

The rider's area of upper deck section 18 advantageously includes foot areas 30 (see FIG. 2). The foot areas 30 extend generally longitudinally and parallel to the sides of the elongated seat 22 so that the operator and any passengers sitting on the seat 22 can place their feet in the foot areas 30. A non-slip surface (not shown) is located in the foot areas 30 to provide increased grip and traction for the operator and the passengers. A pair of raised side gunnels 31 define the foot areas 30. The side gunnels 31 desirably extend generally parallel to the central seat 22.

The lower hull section 16 of the personal watercraft 10 includes an engine compartment 32. In the exemplary watercraft depicted in FIG. 1, a fuel tank 34 and a buoyant block (not illustrated) are located in the front portion of the compartment 32. The buoyant block affords additional buoyancy to the watercraft 10.

An internal combustion engine 36 forms part of a propulsion system 38 which powers the watercraft 10. The engine 36 is located in the engine compartment 32 beneath the front end 24 of the seat 22.

An exhaust system 37 discharges exhaust gases from the engine to the atmosphere through a discharge opening. In the illustrated embodiment, the discharge opening is formed on the transom of the watercraft; however, it can be located within a tunnel on the underside of the hull, as known in the art.

A battery can be positioned proximate to the engine to provide a source of electrical power for accessories of the watercraft 10 and for starting the engine. The cushion of the seat 22 desirably can be removed to provide access to the engine and the battery.

The engine 36 drives a jet propulsion unit 40 to propel the watercraft 10. The jet propulsion unit 40 is positioned in a tunnel 42 in the rear center of the lower hull section 16. The engine output shaft drives an impeller shaft 44, which in turn drives an impeller 46 of the propulsion unit 40. The pressurized water is discharged through a discharge nozzle 48.

A steering nozzle 50 receives the water jet and discharges it in a desired direction in order to steer the watercraft in a known manner. The steering nozzle 50 is pivotally supported at the rear of the jet propulsion unto change the thrust angle on the watercraft 10 for steering purposes as is known in the art.

The steering nozzle 50 is connected to a steering handle 52. The steering handle 52 forms part of the operator controls 26 which are mounted in front of the operator seat 24 as noted above. The steering handle 52 can also include a throttle control for controlling the speed of the engine and one or more control boxes for housing control switches, as explained below.

As best understood from FIGS. 1 and 3, the lower hull section 16 generally has a "V"-bottom formed by a pair of angularly disposed surfaces 54 which extend outwardly. The surfaces 42 extend outwardly from a central recess section which forms a portion of the tunnel section 42 at the rear of the lower hull section 16. Each angularly disposed surface 54 of the lower hull section 16 can include one or more inner chines 56 as is known in the art.

The central recessed section includes the water inlet port (not shown) for the jet propulsion unit 40. The downwardly facing inlet is located proximate the rear of the watercraft 10 and communicates with the body of water in which the watercraft 10 is operated. The jet propulsion unit thus draws water through the inlet and into the tunnel 42.

The angularly disposed surfaces 54 terminate at longitudinally extending side walls 58. The side walls 58 are inclined more steeply than the angularly disposed surfaces 54. The side walls 58 are generally flat and straight near the stem of the watercraft hull 14 and smoothly bend toward the longitudinal center of the watercraft 10 toward the bow. The lines of intersection between the angularly disposed surfaces 54 and the corresponding side walls 58 form outer chines 60 of the lower hull section 16.

The personal watercraft 10 so far described is conventional and represents only an exemplary watercraft on which the present adjustable sponson system 8 can be employed. A further description of the personal watercraft 10 therefore is not believed necessary for an understanding and an appreciation of the present adjustable sponsons 12. The adjustable sponson system 8 will now be described in detail.

With reference now to FIGS. 1, 3, 4 and 5, the illustrated embodiment includes a pair of sponson bodies of the adjustable sponson module (collectively referred to by reference numeral 12) are attached to the sides 58 of the watercraft 10; however, the watercraft 10 can include any number of adjustable sponsons in order to suit a particular application or loading condition. As understood from FIGS. 1 and 3, a starboard side sponson 12*a* extends from the starboard side of the lower hull section 16 and a port side sponson 12*b* extends from the port side of the lower hull section 16. Each sponson 12 desirably is attached above the outer chine 60 on the corresponding side 58 of the lower hull 16 of the watercraft 10 (see FIG. 3). The sponsons 12 are positioned approximate to the stem of the watercraft 10 and extend outwardly for increased buoyancy and stability. The sponsons 12 also can be arranged at an angular orientation relative to the outer chines 60 to give the watercraft 10 different handling characteristics depending upon the orientation of the sponsons 12.

Figure 5:
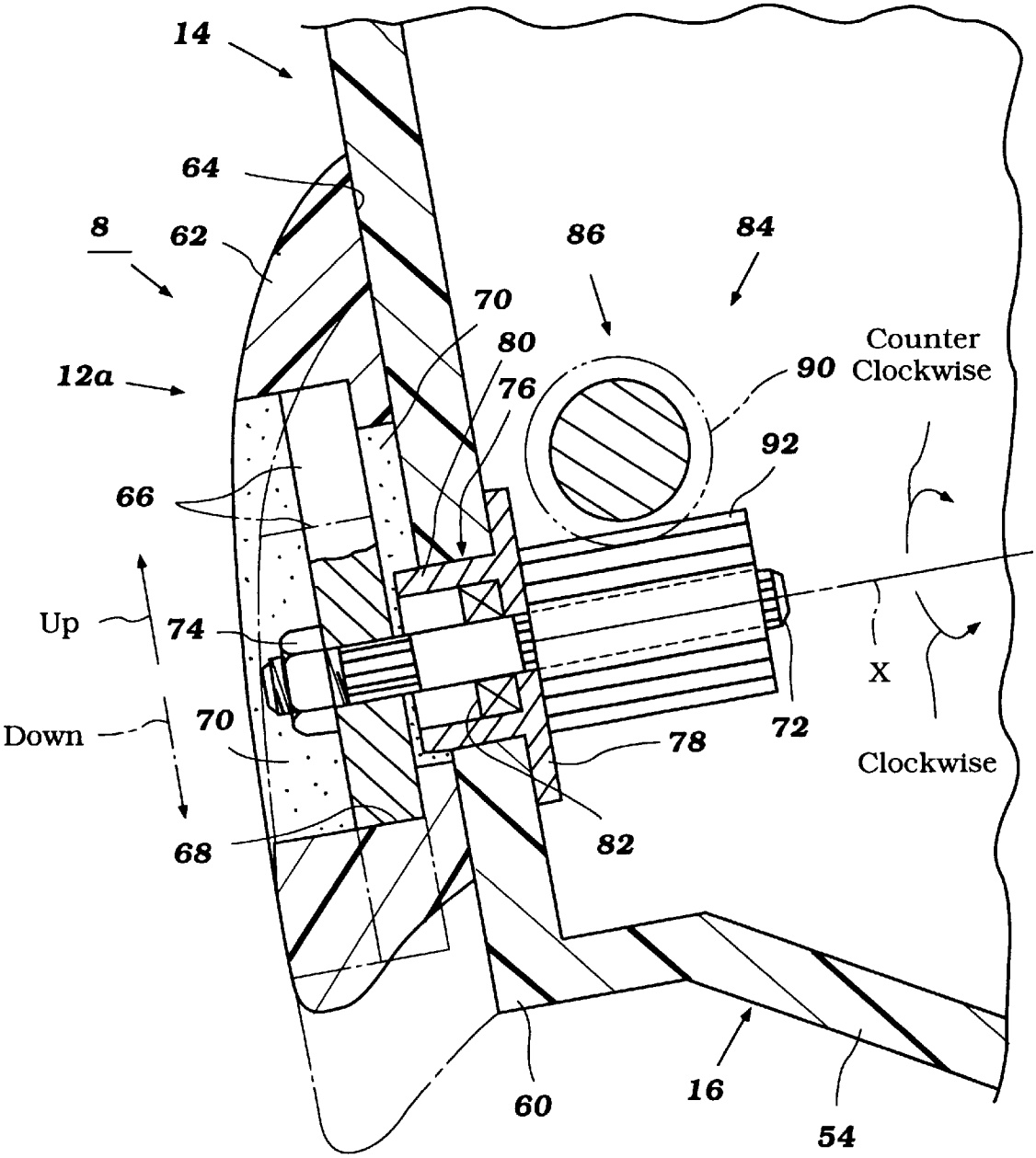
FIG. 5 is an enlarged cross-sectional view of the port side sponson of the adjustable sponson system illustrated in FIG. 1 taken along line 5—5.

It is contemplated that the port and starboard side adjustable sponson modules 12 (i.e., the adjustable sponson subsystem comprising the sponson and the corresponding actuator) will be identical, apart from the sponson bodies being mirror images of each other. The description herein of one adjustable sponson module 12 therefor will be understood as applying equally to both unless specified to the contrary. As best seen in FIGS. 1, 3 and 5, each sponson 12 has an elongated rib-like body 62 with a length substantially shorter than the length of the hull 14. In the illustrated embodiment, the sponson 12 has a length roughly equal to about one-sixth of the length of the watercraft 10. For heavier watercraft or for watercraft designed to accommodate multiple passengers, however, longer sponsons can be used.

The shape of the sponson body 62 tapers from its aft end to a generally blunt nose positioned at the fore end to give the body substantially stream-like shape in a direction of water flow over the sponson. In other words, the lateral width of the sponson body 62 increases from its blunt nose to its aft end.

As best seen in FIGS. 3 and 5, an outer portion of the aft end of the sponson body 62 protrudes downward to give the sponson a generally fin-like shape. The sponson 12 also include an arcuate lower surface formed on an underside of the sponson body 62. The arcuate lower surface extends away from the corresponding side 58 of the lower hull section 16.

An outer portion of the sponson body also tapers in size in the vertical direction (i.e., in a direction generally normal to the water surface WL) such that the outer portion smoothly transitions into the blunt nose of the sponson body 62 in the forward direction. That is, the degree to which the sponson body protrudes downward decreases gradually tapers towards its fore end and blends smoothly into the fore end. The fore end of the sponson body 62 does not significantly protrude downward, if at all.

The size and shape of the sponson body 62 is desirably selected according to the preference of the particular rider and the number of riders. It is contemplated that other shapes and sizes of sponson bodies 62 can be used, as understood from the additional embodiments which follow.

As best seen in FIG. 5, the sponson body 62 also includes a generally flat inner mounting surface 64 which abuts the side 58 of the lower hull section 16 when assembled. A coupling mechanism for the adjustable sponson 12 couples the sponson body 62 to the lower hull section 16 and allows adjustment of the angular orientation and/or vertical position of a sponson body 62 relative to the corresponding outer chine 60 of the lower hull section 16, as described below.

In the illustrated embodiment, the coupling mechanism includes three circular disks 66 which are contained within the sponson body 62. For this purpose, the sponson body 62 includes a plurality of circular holes 68 which receive the circular disks 66. Plug elements 70 are placed on the inner and outer sides of the sponson body 60 to enclose each of the disks 66 in place. Each circular disk 66, as well as the corresponding plug elements 70, includes a through hole.

A rotational shaft 72 is connected to each circular disk 66. The shaft 72 desirably includes external splines which cooperate with internal splines formed within the hole of the circular disk 66. The shaft 72 projects from the inner side of the disk 66 through the hole of the inner plug element of the sponson body 62. A nut or similar fastener 74 engages an outer end of each shaft 72 through the hole of the outer sponson body plug 70 to secure the sponson body 62 onto the shafts.

Each shaft 72 is supported by a bushing 76 positioned within a hole that extends through the wall 58 of the lower hull portion 16. Each bushing 76 includes a flange 78 which mates against an inner surface of the side wall 58 and includes an angular collar 80 which extends through the wall 58 and fits within a counterbore formed within the inner plug element 70 of the sponson body 62.

The bushing 76 also includes a central hole through which the corresponding rotational shaft 72 extends. A seal 82 is placed between the bushing 76 and the shaft 72 to prevent egress of water into the hull 14 through the hole in the side wall 58. In this manner, each bushing 76 supports the corresponding rotational shaft 72 and permits rotational movement of the shaft 72 relative to the bushing 76 and the seal 82. The shaft 72 in turn couples the sponson body 62 to the side wall 58.

The shafts 72 and disks 66 also define a travel path of the sponson relative to the side wall. Each shaft 72 is eccentrically positioned on the respective disk 66. Thus, rotational movement of the shaft 72 about a fixed axis X causes the attached sponson body 62 to move vertically relative to the rotational axis X. In the illustrated embodiment, the shafts 72 desirably rotate 180 degrees from a fully raised position, in which the shafts 72 lie at the lower ends of the disks 66, to a fully lowered position, in which the shafts lie at the upper ends of the disks 66, to guide and define the travel path of the corresponding sponson 12.

The adjustable sponson system 8 also desirably includes an actuator 84 to move the sponson 12 relative to the hull 14. In the illustrated embodiment, the actuator 84 includes a gear train 86 driven by an electric motor 88. The gear train 86 includes a worm gear 90 which drives a plurality of pinions 92.

Each rotational shaft 72 supports one of the pinions 92 on its inner side. In the illustrated embodiment, the inner end of each rotational shaft 72 includes an external spline which cooperates with an internal spline of the pinion 92. A suitable fastener holds the pinion 92 onto the end of the rotatable shaft 72.

Figure 4:
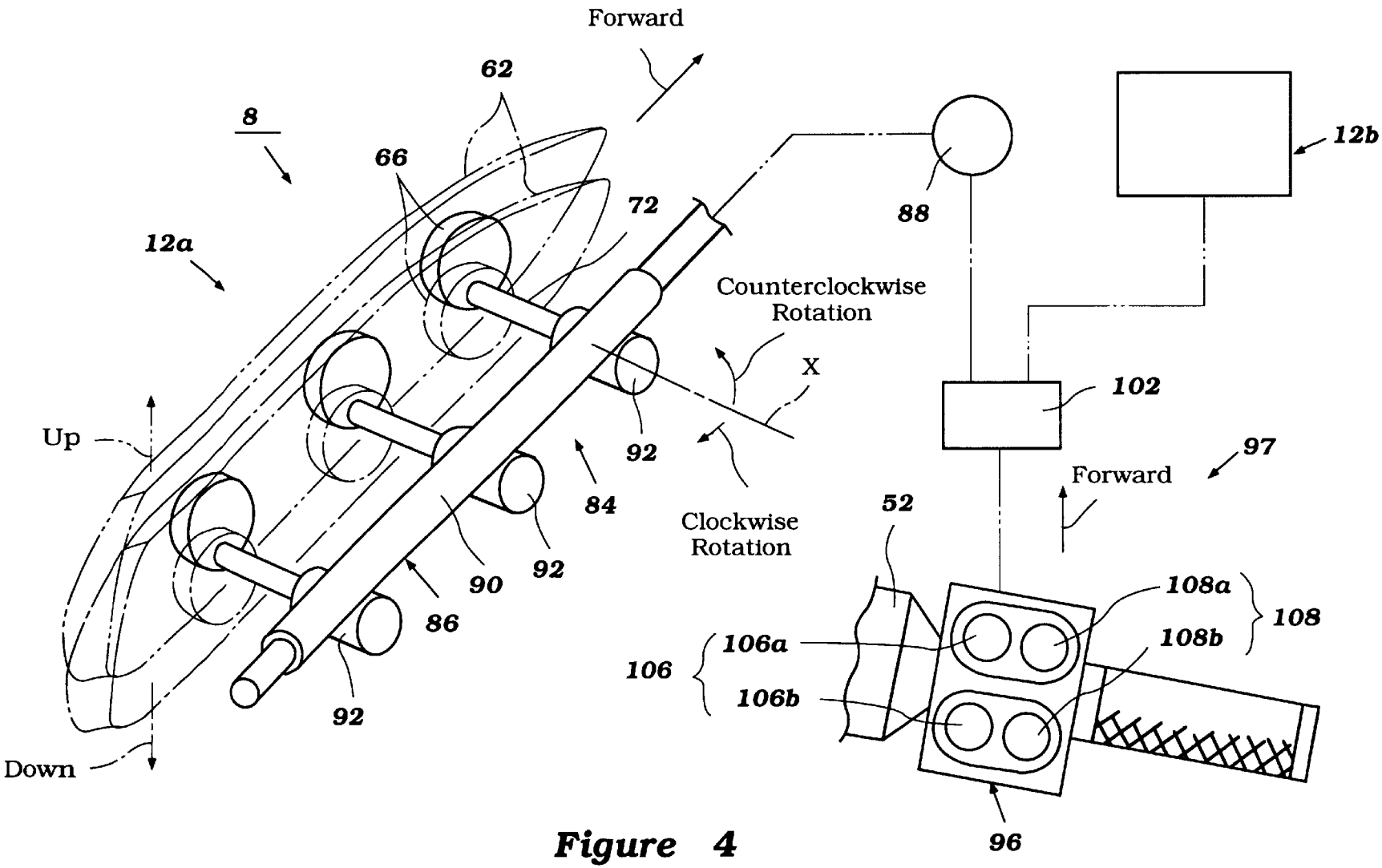
FIG. 4 is a schematic view of the adjustable sponson system of FIG. 1.

As best understood in FIG. 4, the worm gear 90 cooperates with the pinions 92. The worm gear 90 includes a corresponding thread which cooperates with the teeth of the pinions 92 in a known manner. The worm gear 90 desirably is held in mesh engagement with the pinions 92 and is suitably journalled for rotation relative to the pinions 92. In this manner, rotation of the worm gear 90 drives the pinions 92 to rotate the rotatable shafts 72 in unison.

The electric motor 88 can be a reversible stepper motor or similar type of reversible actuator motor which drives the worm gear 90 in two rotational directions so as to raise and lower the sponson 12 on the side of the watercraft 10. By rotating the worm gear 90 in a first direction, the worm gear rotates the pinions 92 and corresponding rotational shafts 72 in a corresponding direction (e.g., clockwise direction) to raise the sponson 12 on the side of the watercraft hull 10. That is, the rotational movement of the eccentrically positioned shafts 72 rotates the circular disks 66 upwardly. As a result, the sponson 12 moves upwardly to a raised position. Likewise, by rotating the worm gear 90 in an opposite direction, the circular disks 66 are rotated in an opposite direction (e.g., counter clockwise direction), to lower the sponson 12 on the side of the watercraft hull 14.

Once the position of the sponson has been adjusted, the inertia of the motor and the gear train generally inhibit movement of the sponson relative to the side wall 58. In addition, the motor (especially if a stepper-type motor) may include a self-locking feature to prevent unintentional rotation of the worm gear 90. In this manner, the actuator provides a locking mechanism to inhibit unintended movement of the corresponding sponson 62.

An operator 94 desirably controls the operation of the associated actuators 84. The operator 94 desirably is remotely positioned relative to the actuators 84 and lies within or near the rider's area on the upper deck 18. As understood from FIGS. 1 through 5, the operator 94 can take the form of a control unit 96 positioned on the handlebar assembly 52 of the watercraft 10 or positioned on an upper deck surface 98 in front of the rider's seat 24, or can take the form of foot pedals 100 positioned within the foot wells 30 in the rider's area.

No matter what form, the operator 94 desirably includes at least one control element which produces a control signal that is received by an electronic control unit 102. In the illustrated embodiment of FIG. 4, the control element includes a switch 106 mounted on a rearwardly facing surface of the control box 96 on the watercraft handlebars 52. The electronic control unit 104 is housed within the hull 14, for instance in a position behind the engine 36 or directly beneath the control assembly 26. The electronic control unit 104 receives the control instructions from the operator control element 106 and operates the actuator 84 to impart the desired movement to the sponson 12. The duration of actuation of the operator control element 106 desirably corresponds to the degree of movement of the sponson 12 relative to the side wall 58 such that the sponson 12 can be incrementally adjusted.

In the illustrated embodiment, the operator 94 includes two switches per actuator 84. One pair of switches 106 controls the actuator 84 of the port side module 12*a,* while the other pair of switches 108 controls the actuator 84 of the starboard side module 12*b*. Within each pair, one switch 106*a,* 108*a* controls the upward movement of the corresponding sponson body 62 and the other switch 106*b,* 108*b* controls the downward movement of the corresponding sponson 62. In this manner, the rider can adjust one of the sponsons 12 without adjusting the other. The left side up and down switches 106*a,* 106*b* illustrated in FIG. 4 therefore comprise a port side control element 106 and the right side up and down switches 108*a,* 108*b* comprise a starboard side control element 108. (the starboard side sponson and actuator (i.e., the starboard side module) are schematically illustrated in block form in FIG. 4; however, it is to be understood that the construction of the actuator and its interaction with the starboard side sponson module is similar to that described above in connection with the port side module of the adjustable sponson system.)

Figure 6:
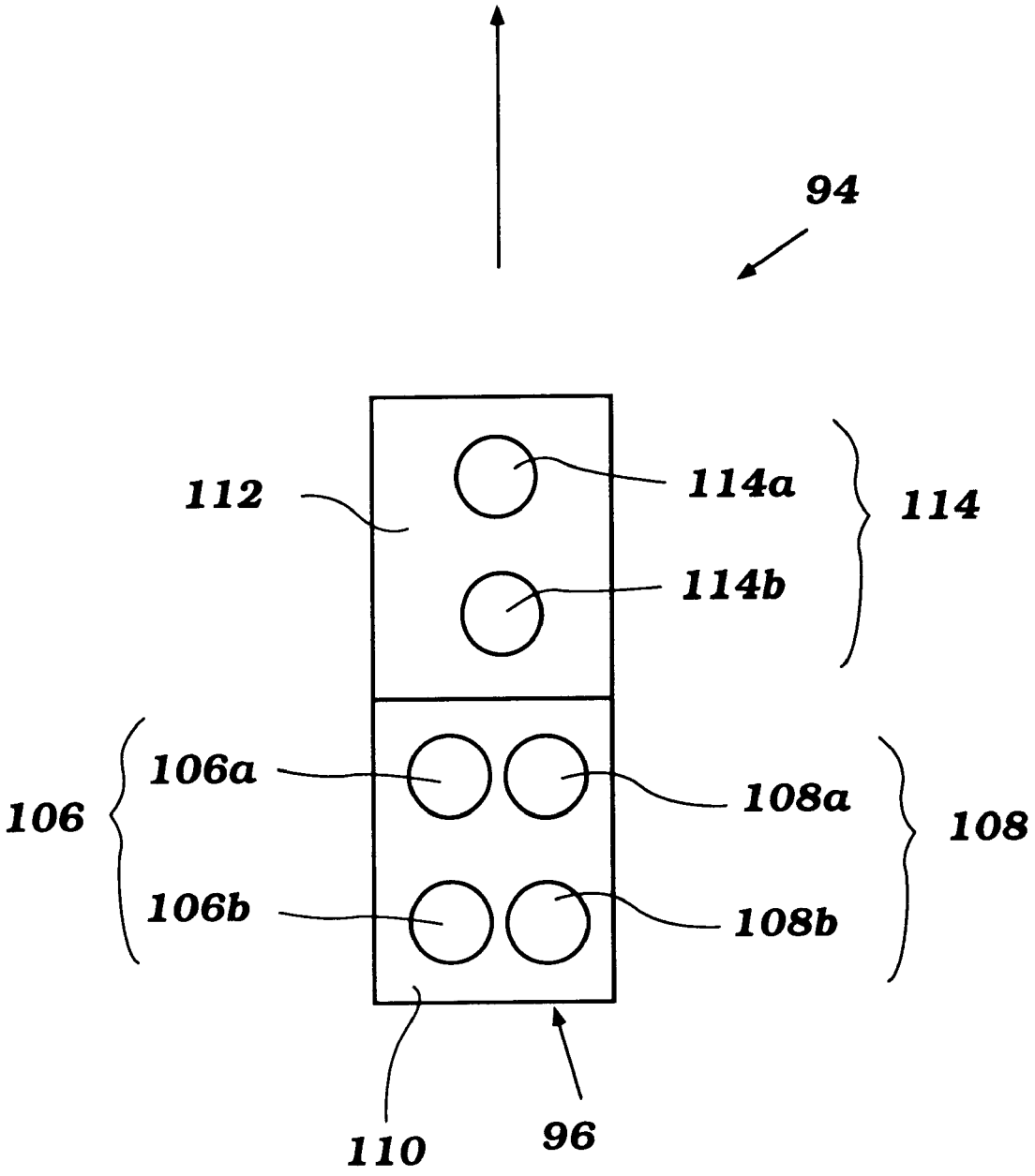
FIG. 6 is another embodiment of an operator that can be used with the adjustable sponson system of FIG. 4.
Figure 7:
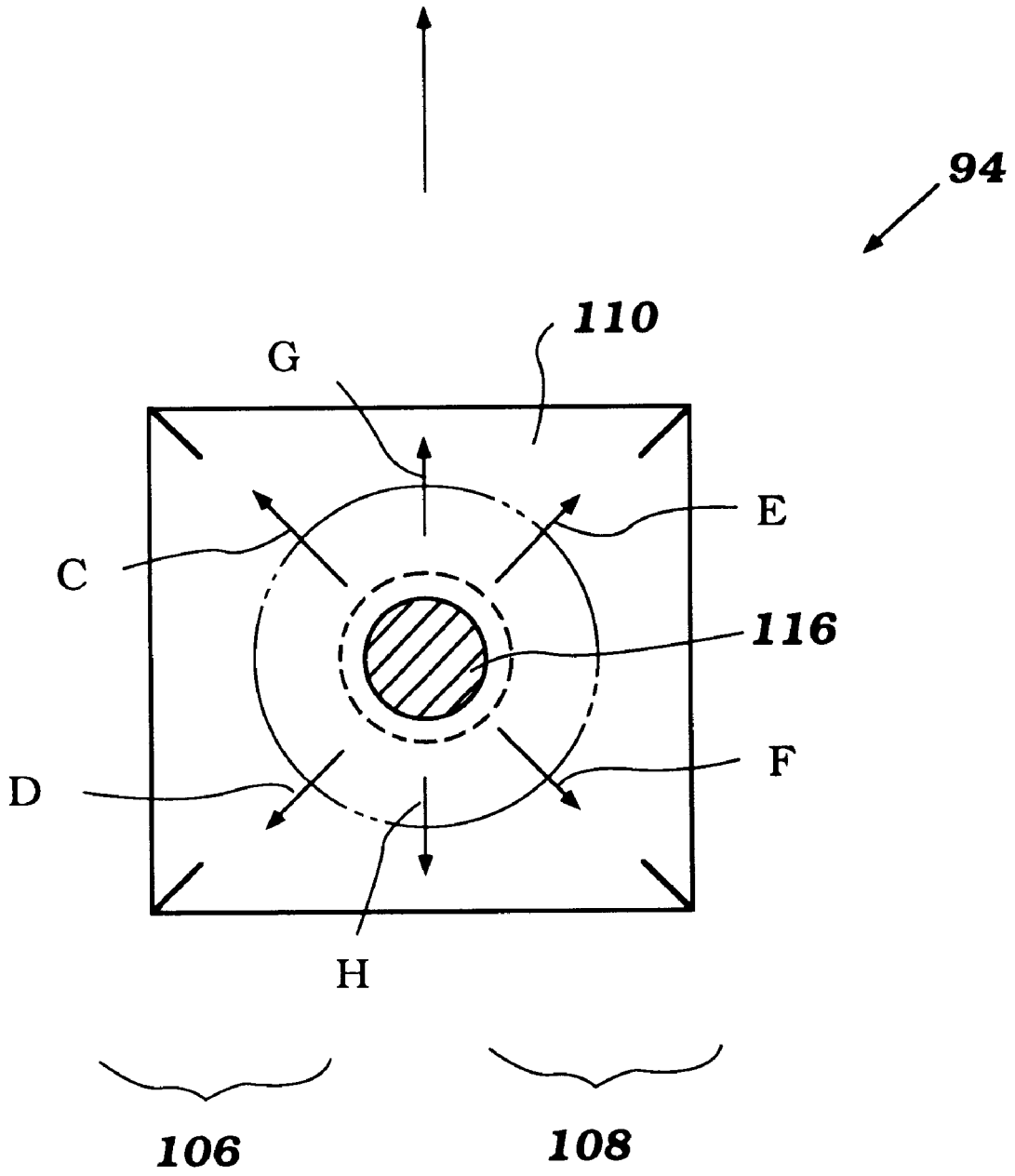
FIG. 7 is an additional embodiment of an operator that can be used with the adjustable sponson system of FIG. 4.
Figure 8:
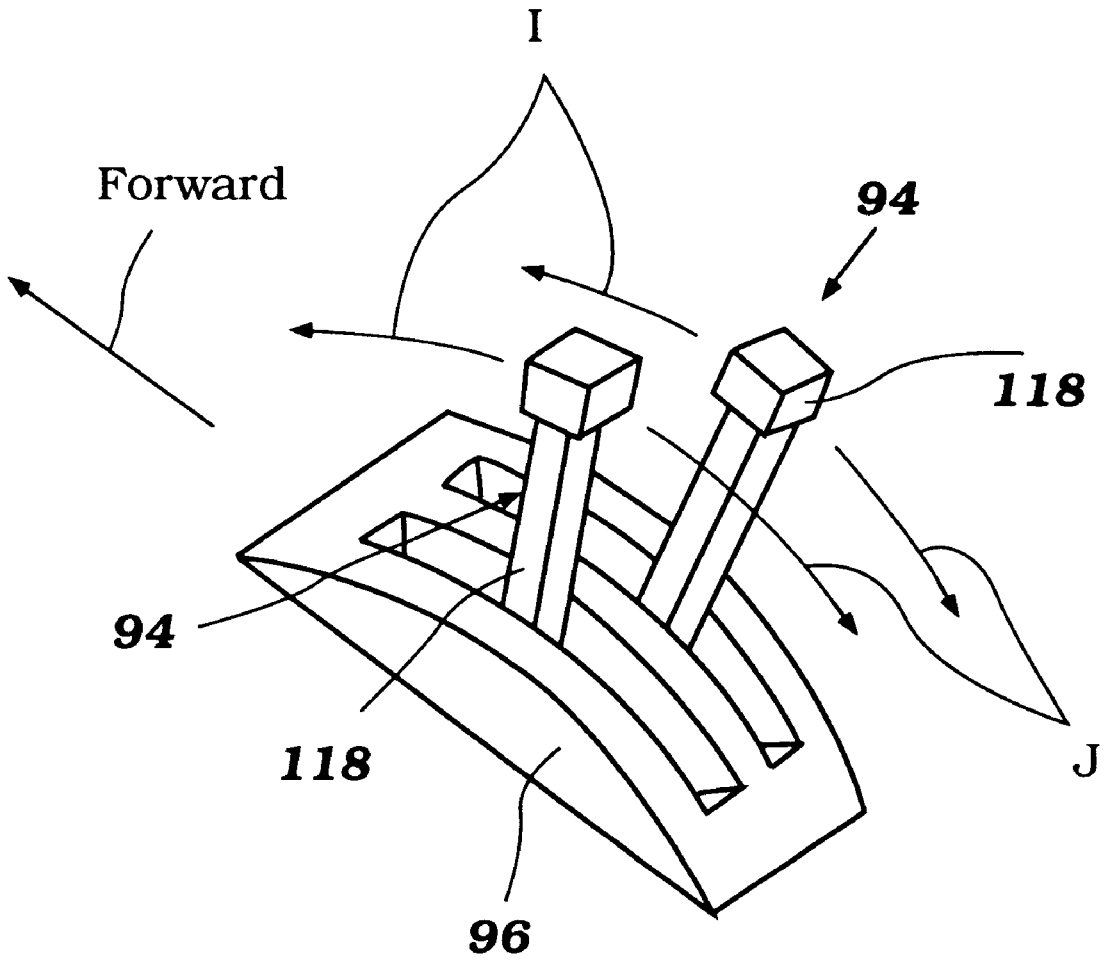
FIG. 8 is yet another embodiment of an operator that can be used with the adjustable sponson system of FIG. 4.
Figure 9:
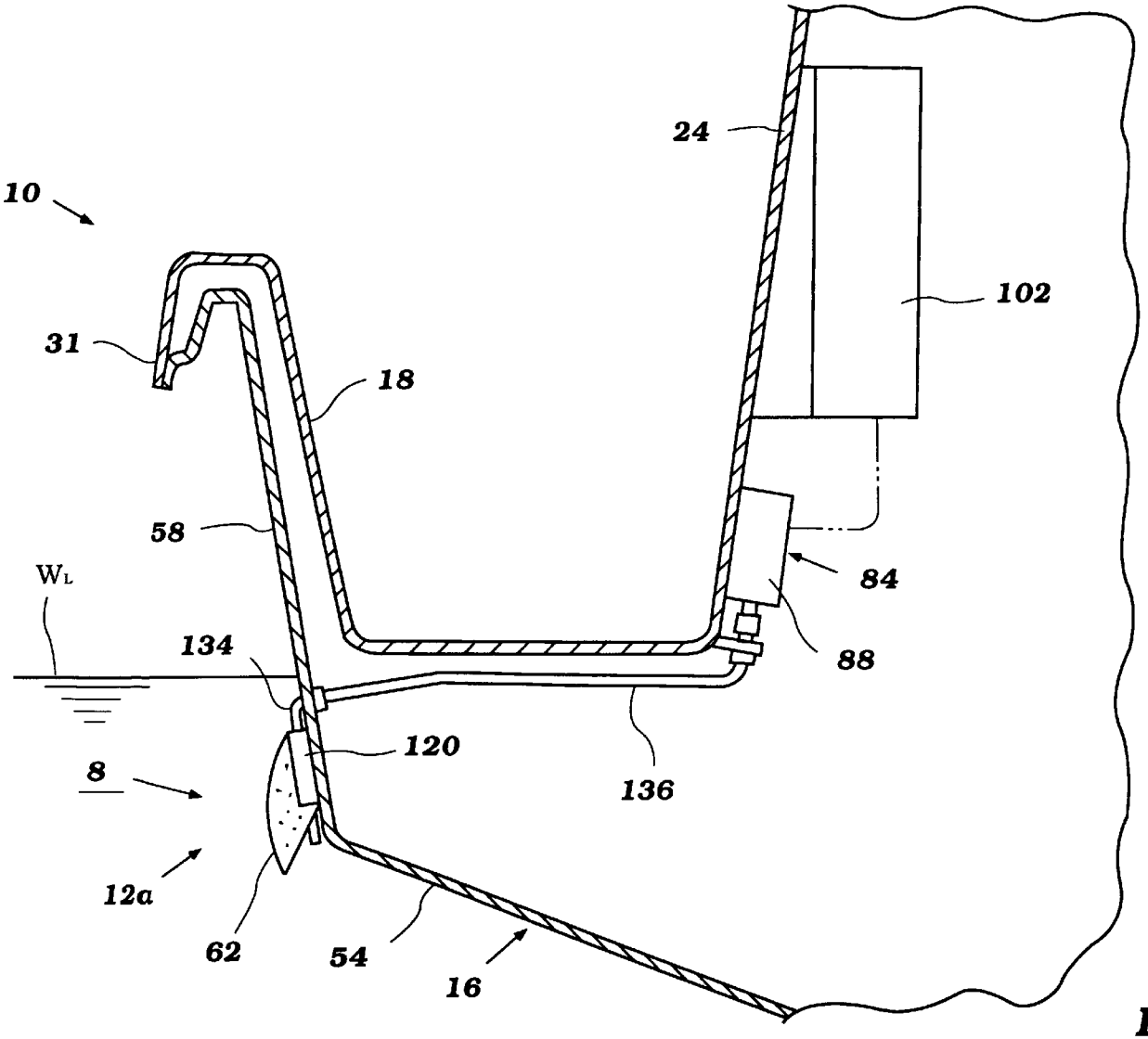
FIG. 9 is an enlarged, partial cross-sectional view of a watercraft hull and illustrates a port-side module of an adjustable sponson system configured in accordance with another preferred embodiment of the present invention.

FIGS. 6 through 8 illustrate several additional embodiments of operators which can be used with the above described adjustable sponson system 8. In each of the following embodiments, like reference numerals have been used to indicated like components between the embodiments. Thus, unless indicated to the contrary, the above description of those common elements applies equally to the following embodiments.

In FIG. 6, the operator 94 includes a control box 96 having a rearwardly facing side surface 110 and a top side surface 112. The side surface 110 includes four switches 106*a,* 106*b,* 108*a,* 108*b*. The left two switches 106*a,* 196*b* control the up and down movement of the port side sponson 12 as described above, and the right side switches 108*a,* 108*b* control the up and down movement of the port side sponson 12. The top side 112 of the control box 96 includes two additional switches 114*a,* 114*b*. One switch 114*a* desirably causes the actuators 84 of the port and starboard side modules 12 to move the sponsons 62 simultaneously upward and by an equal degree. The other switch 114*b* desirably causes the actuators 84 of the port and starboard side modules 12 to move the sponsons 62 simultaneously downward and by an equal degree. These switches 114*a,* 114*b* together comprises uniform adjustment control element 114 which ensures the sponsons move in unison.

FIG. 7 illustrated another embodiment of an operator 94 which includes a joystick type control element 116 which can be moved at least six directions to produce six different control signals which the electronic control unit 102 receives. In the illustrated embodiment, a movement of the joystick 116 in direction C causes the port side sponson 12*a* to raise upwardly and movement of the joystick 116 in direction D causes the port side sponson 12*a* to move downwardly. Likewise, movement of the joystick 116 in direction E causes the starboard side sponson 12*b* to move upward and movement of the joystick 116 in direction F causes the starboard side sponson 12*b* to move downward. In addition, movement of the joystick 116 in direction G raises both sponsons 12 while movement of the joystick 116 in direction H lowers both sponsons 12 simultaneously and to the same degree.

As seen in FIG. 8, the operator 94 can comprise a conventional control unit 96 having at least two operator arms 118. Each operator arm 118 pivots about a support shaft (not shown). A conventional potentiometer senses the degree of rotational movement of the operator arm and produces an output signal received by the control unit 102. The operator arms 118 can be moved together by simultaneously grasping the handles at the upper ends of the operator arms 118 or can be moved separately. Movement of the operator arms 118 in direction I causes the respective sponsons 12 to move in one direction (e.g., upward) while movement of the operator arms in the opposite direction causes the sponsons 12 to move in an opposite direction (e.g., downward).

With reference to FIGS. 9 through 12, an adjustable sponson system 8, which is configured in accordance with another embodiment of the present invention, is provided. As with the above described embodiment, it is contemplated that the structure of the port and starboard side adjustable sponson modules 12 will be identical apart from the sponson bodies being mirror images of each other. The following description of one adjustable sponson module therefore will be understood as applying equally to both unless specified to the contrary.

The coupling mechanism in the present embodiment includes a base plate 120 which is mounted onto the exterior surface of the corresponding hull side wall 58 by plurality of fasteners 122. In the illustrated embodiment, the fasteners 112 include a plurality of bolts which extend through the side wall 58 of the hull 16 and cooperate with nuts positioned on the exterior side of the base 120. The base 120 includes a plurality of through holes which receive the support bolts and a plurality of counterbores in which the nuts are located. The cooperation between the nuts and corresponding bolts fix the base plate 120 onto the hull side wall 58. The base plate 120 also includes a plurality of larger holes with corresponding counterbores formed so as to extend into the base 120 from an inner surface of the base 120. Each of the holes receive a bushing 124.

Each bushing 124 includes a central body member and an enlarged collar. The central body member fits snugly within the hole while the enlarged collar slip-fits within the counterbore. The bushing 124 also includes a support pin 126 which is eccentrically positioned on the bushing 124. The support pin 126 projects outwardly away from the base 120.

Figure 10:
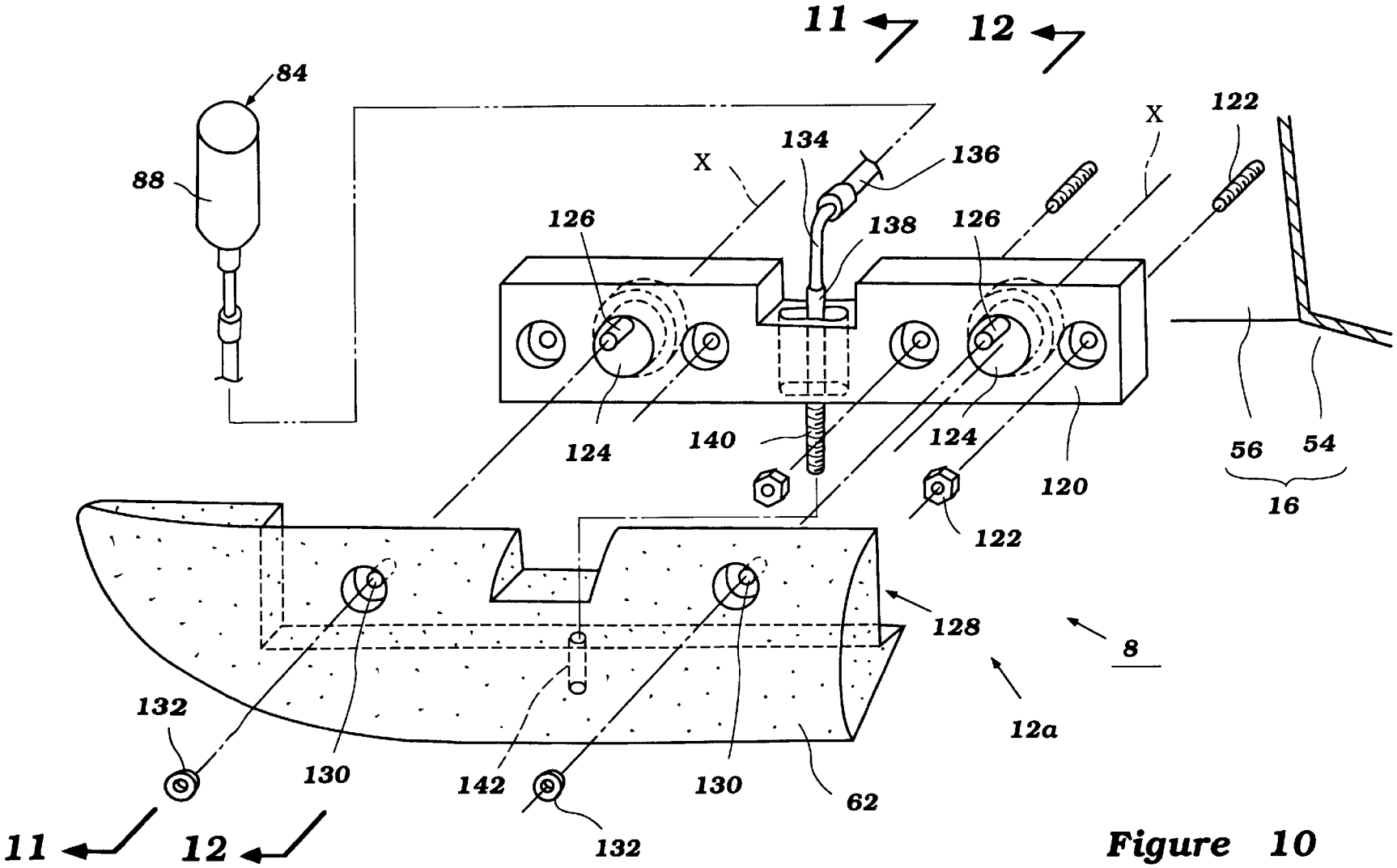
FIG. 10 is a schematic exploded perspective view of the adjustable sponson module of FIG. 9.
Figure 11:
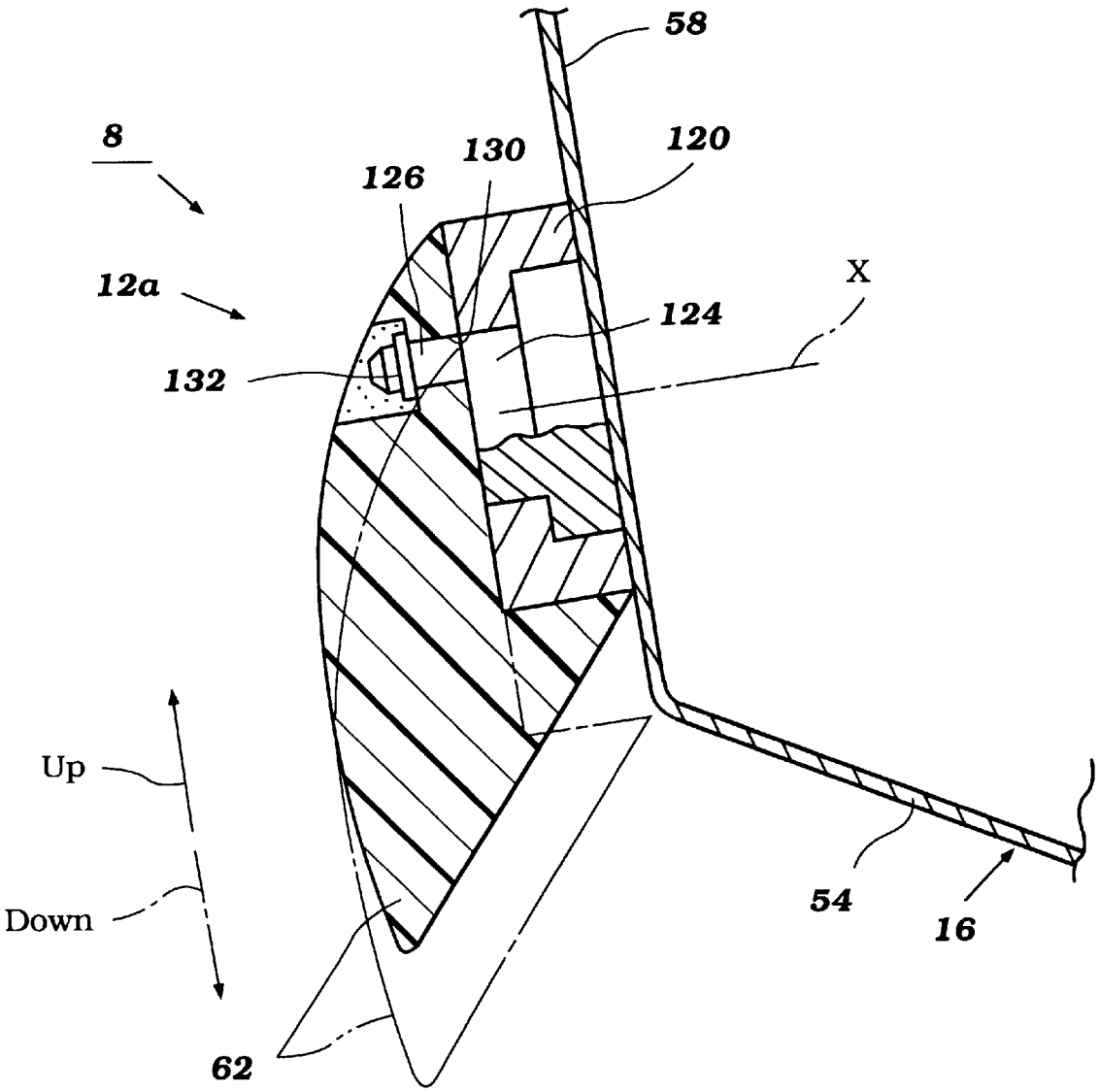
FIG. 11 is a cross-sectional view of the adjustable sponson module of FIG. 10 taken along line 11—11.
Figure 12:
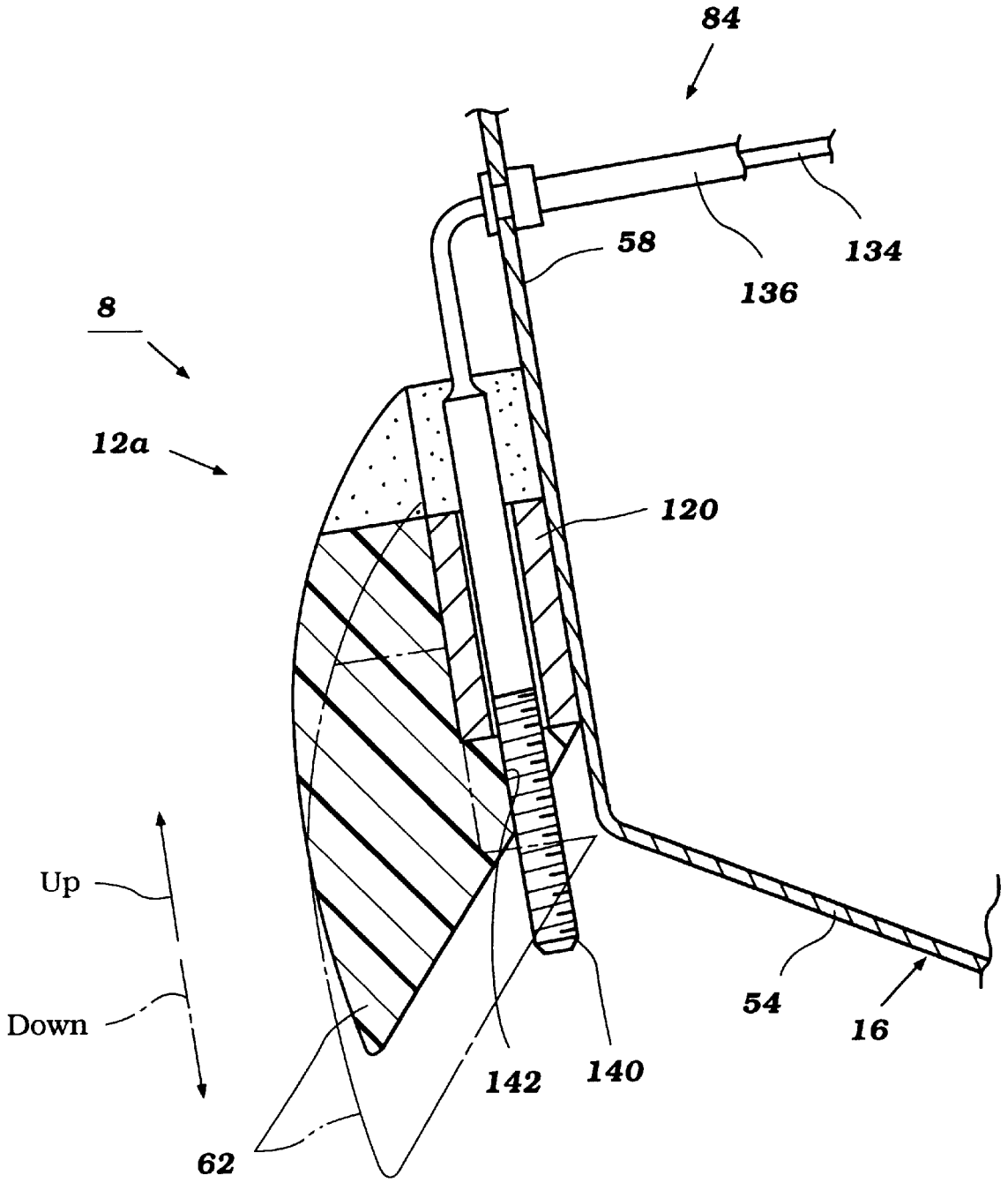
FIG. 12 is a cross-sectional view of the adjustable sponson module of FIG. 10 taken along line 12—12.

As best seen in FIGS. 10 and 11, the sponson body 62 includes a recessed cavity 128 on an inner side of the sponson body 62. The cavity 128 is configured to receive at least a portion of the base 120. In the illustrated embodiment, the cavity 128 has a generally rectangular shape to receive the generally rectangularly shaped base plate 120. The sponson body 62 also includes a plurality of holes 130 which cooperate with the support pins 126 of the bushings 124. The diameter of the holes 130 desirably matches that of the support pins 126. Fasteners 132 (e.g., e rings) are attached onto the outer end of the support pin 126 with the sponson body 62 positioned on the support pins 126. In this manner, the sponson body 62 is coupled to the base plate 120. The sponson body 62 also can include a plurality of plugs which are inserted into counterbore of the sponson body to enclose the end of the support pin 126 and corresponding fastener 132.

Rotation of the bushings 124 moves the sponson body 62 upward and downward relative to the corresponding side wall 58 of the hull 16 due to the eccentric position of the support pins 126. In this manner, the bushings 124, which are secured to the base plate 120, not only function as a coupling mechanism which secures the sponson 62 to the hull 14, but also defines the travel path of the sponson 62 relative to the hull 14.

The adjustable sponson system 8 also includes a drive mechanism or actuator 84 to raise and lower the sponson 62 on the side wall 58 of the hull 16. In the illustrated embodiment, the actuator 84 comprises an electric motor 88 which drives a rotatable cable 134 enclosed within a casing 136. A shank 138 is affixed to the end of the cable 134 and is held generally parallel to the outer surface of the corresponding hull side wall 58. The shank 138 includes a shoulder portion which extends through a slot in the base and a threaded end 140. The threaded end 140 cooperates with a internally threaded hole 142 in the sponson body 62 formed through a lowered surface of the recess 128.

Rotation of the cable 134 causes the shank 138 to rotate. The interaction between the threads of the end 140 of the shank 138 and the sponson 62 causes the sponson body 62 to ride over the threaded section 140 of the shank 138 as understood from FIG. 12.

Although not illustrated, the actuator 84 desirably is operated by a remotely positioned operator 94. For instance, as with the above described embodiments, the operator 94 desirably is positioned approximate to the rider seated in the rider's area 24 of the watercraft. The operator 94 can take any of the described above forms and desirably operates the sponsons 12 independently of each other. The operator 94 produces a control signal which is received by the control unit 102, which in the illustrated embodiment, is mounted to the side wall of the seat pedestal 29 (see FIG. 9). The electronic control unit 102 in turn is connected to the actuators 84 to control the movement of the sponson bodies 62 on the corresponding side walls 58.

Figure 13:
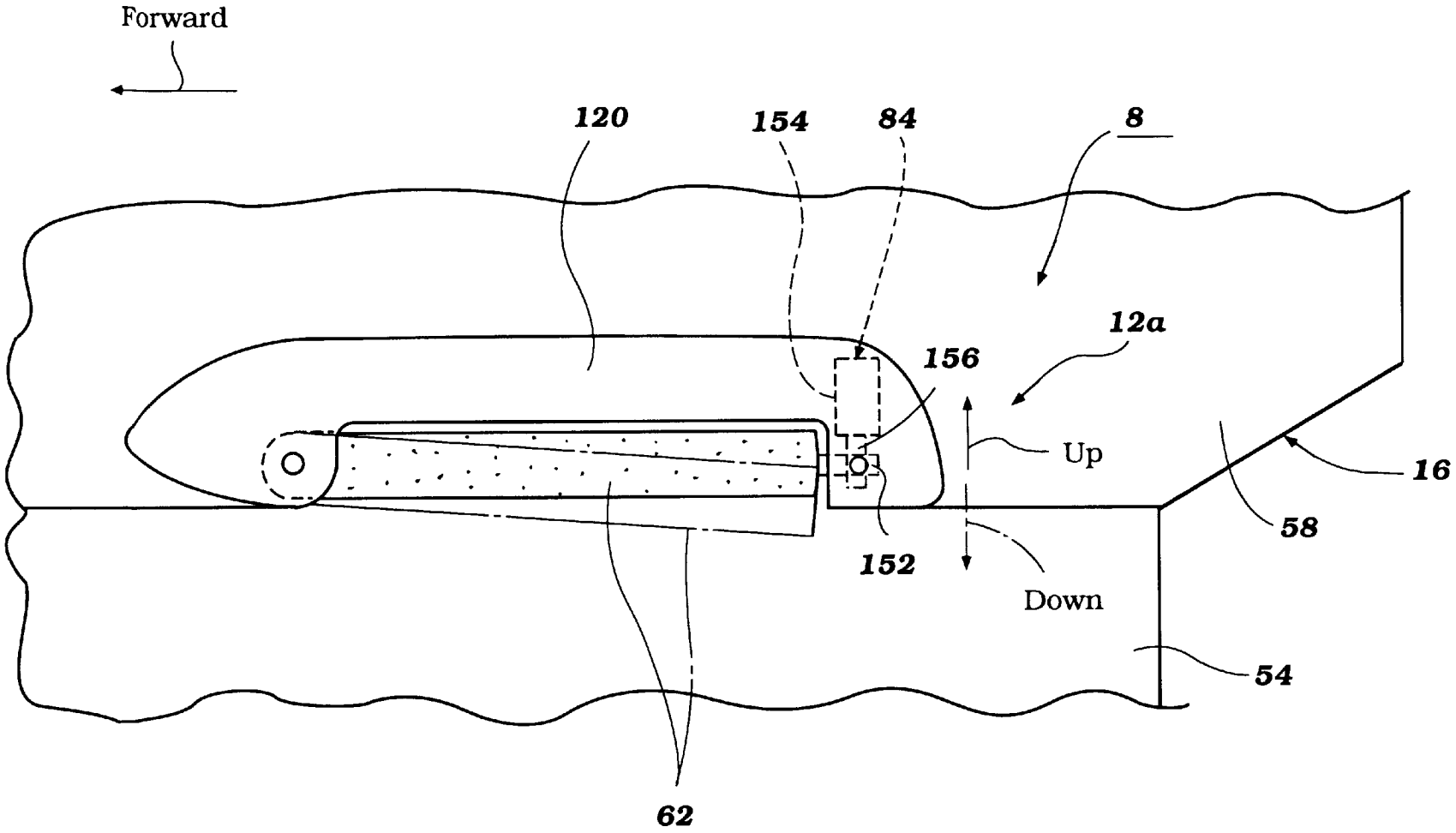
FIG. 13 is a partial side elevational view of a watercraft hull and illustrates a port-side module of an adjustable sponson system configured in accordance with an additional preferred embodiment of the present invention.

FIG. 13 illustrated another embodiment of the sponson 62 and actuator 84 which can be used with the present adjustable sponson system 8. In the illustrated embodiment, a base 120 is secured to the side wall 58 of the hull 16. The base 120 includes a recess 150 which receives a longitudinally extending sponson 62. One end of the sponson 62 is pivotally connected to the base 120. The other end of the sponson 62 is connected to an actuator 84 by a lever 152. The actuator 84 in the present invention desirably comprises a linear cylinder 154 driven by an electric motor (not shown). The cylinder 154 includes an actuator arm 156, which is pivotally connected to the lever 152 of the sponson 62. Movement of the actuator arm 156 upward and downward causes the sponson 62 to pivot relative to the base 120 so as to move the aft end of the sponson 62 upward and downward.

The electric motor of the actuator 84 desirably is controlled by a remote operator via the electronic control unit, as described above. It is also understood that the structure of the port and starboard side modules of the adjustable sponson system will be identical to one another except for the configuration of the sponson and the bases being mirror images of one another. Accordingly, the above described description of the port side module will be understood as applying equally to the starboard side module as well.

Figure 14:
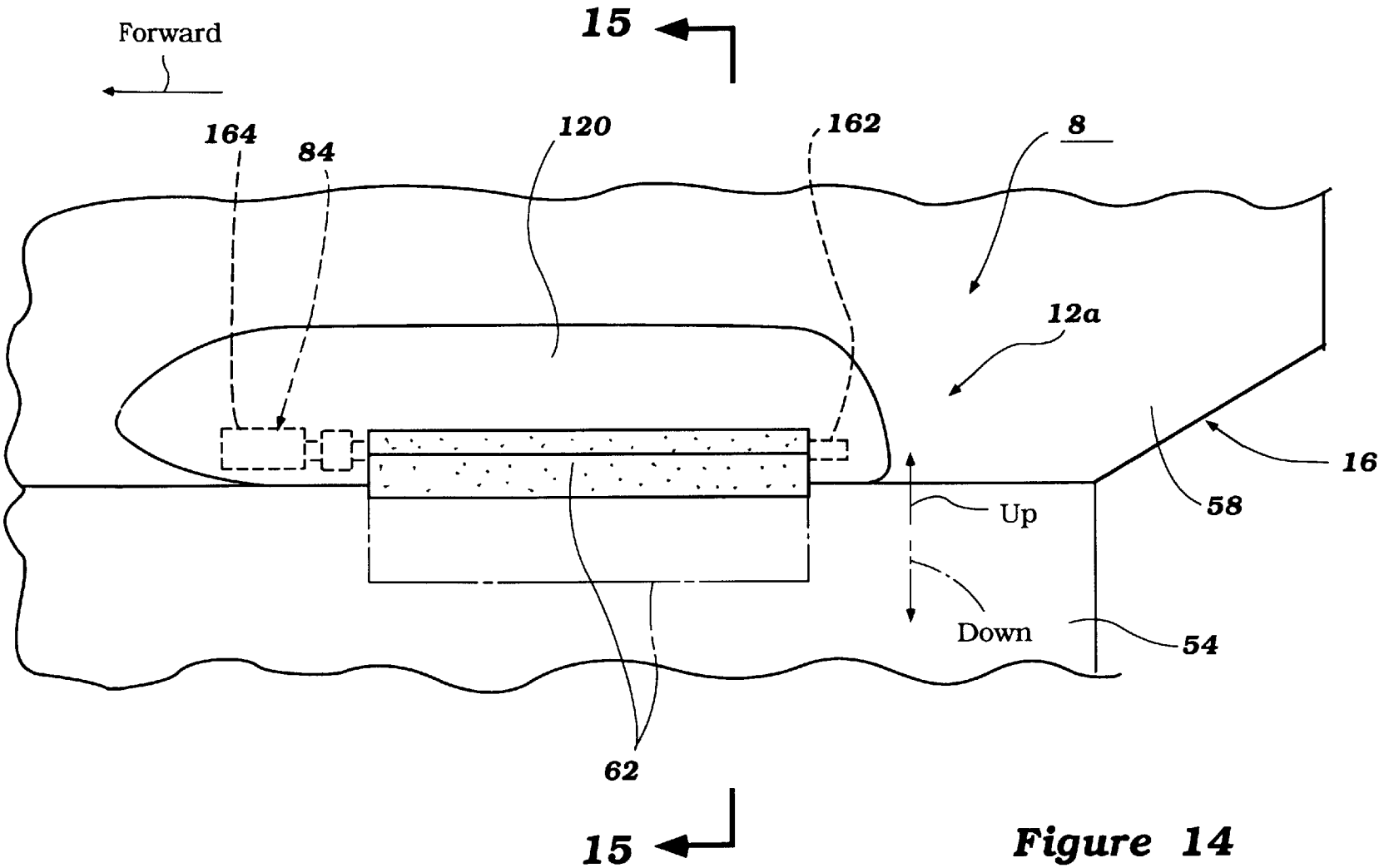
FIG. 14 is a partial side elevational view of a watercraft hull and illustrates a port-side module of an adjustable sponson system configured in accordance with another preferred embodiment of the present invention.
Figure 15:
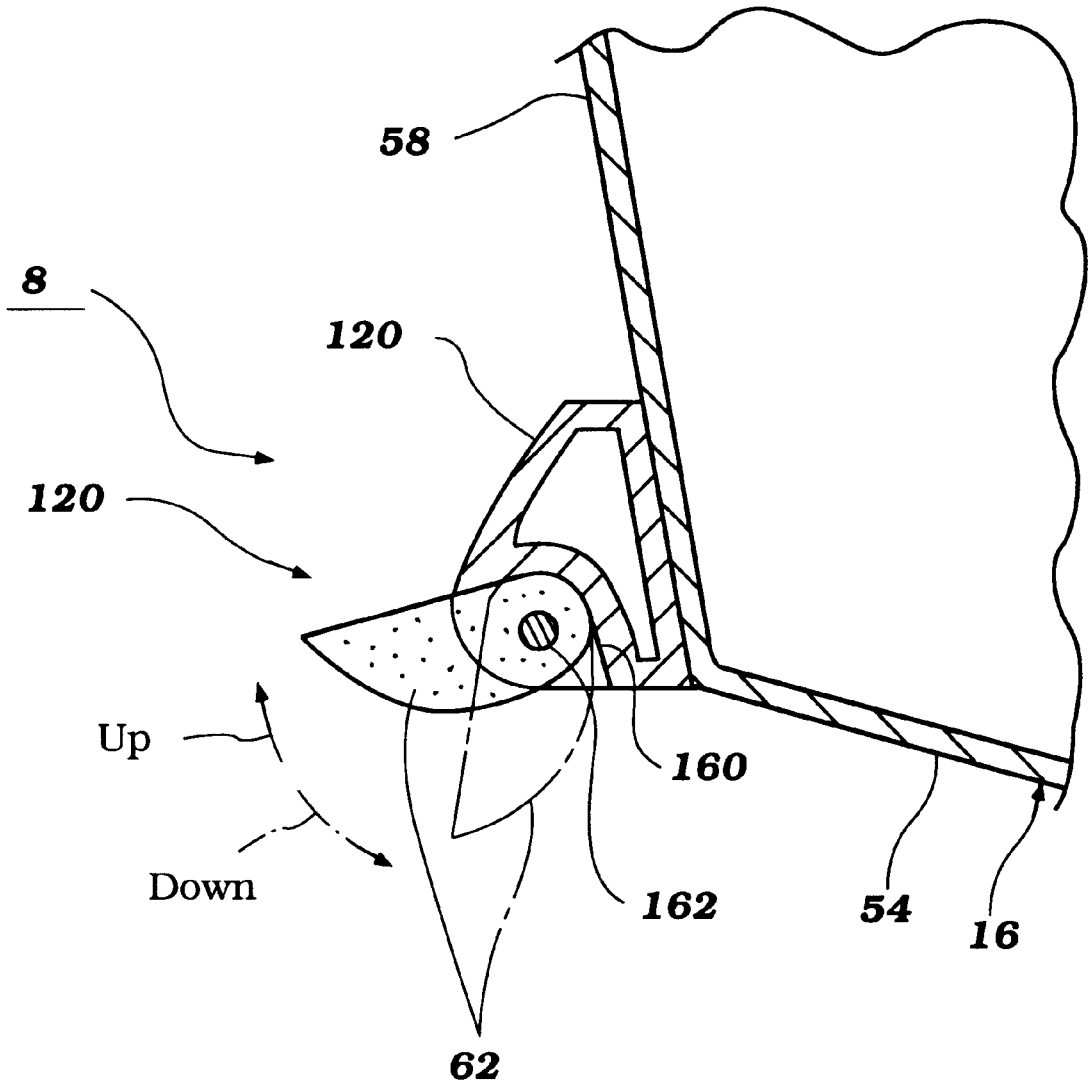
FIG. 15 is an enlarged cross-sectional view of the adjustable sponson module of FIG. 14 taken along line 15—15.

FIGS. 14 and 15 illustrate another embodiment of a actuator/sponson module 12 which can be used with the present adjustable sponson system 8. Again, the structure of the port and starboard modules desirably are identical, apart from the shape of the sponson and base, and therefore the following description should be understood as applying equally to both, unless otherwise specified.

The base 120 includes a generally flat inner surface which is affixed to the outer surface of the corresponding hull side wall 58. A curvy linear recess 158 is formed on the outside of the base 120 and receives an inward portion of the sponson body 62. A support shaft 162 desirably supports the sponson inward portion and allows rotation of the sponson 62 relative to the base 120, as best understood from FIG. 15. In the illustrated embodiment, the sponson 62 is affixed to the rotatable shaft 162 so as to rotate therewith.

A rotatable actuator 164 drives the rotatable shaft 162 to rotate the sponson 62 between a raised position and a lowered position. In the illustrated embodiment, the rotatable actuator 164 includes an electric motor (e.g., the stepper motor) which responds to control signals sent from a remote operator via the electronic control system, in the manner described above.

Figure 16:
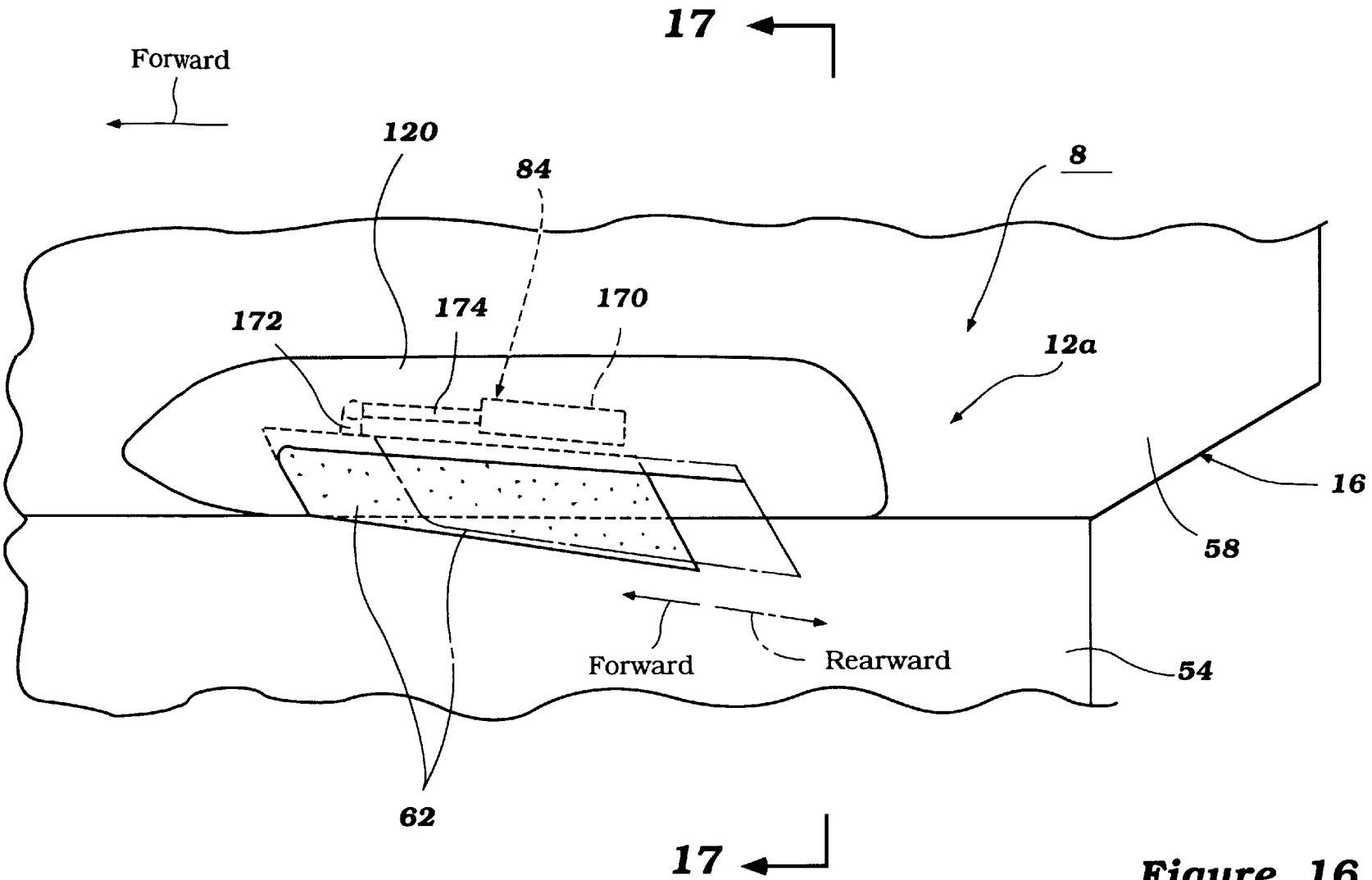
FIG. 16 is a partial side elevational view of a watercraft hull and illustrates a port-side module of an adjustable sponson system configured in accordance with an additional preferred embodiment of the present invention.
Figure 17:
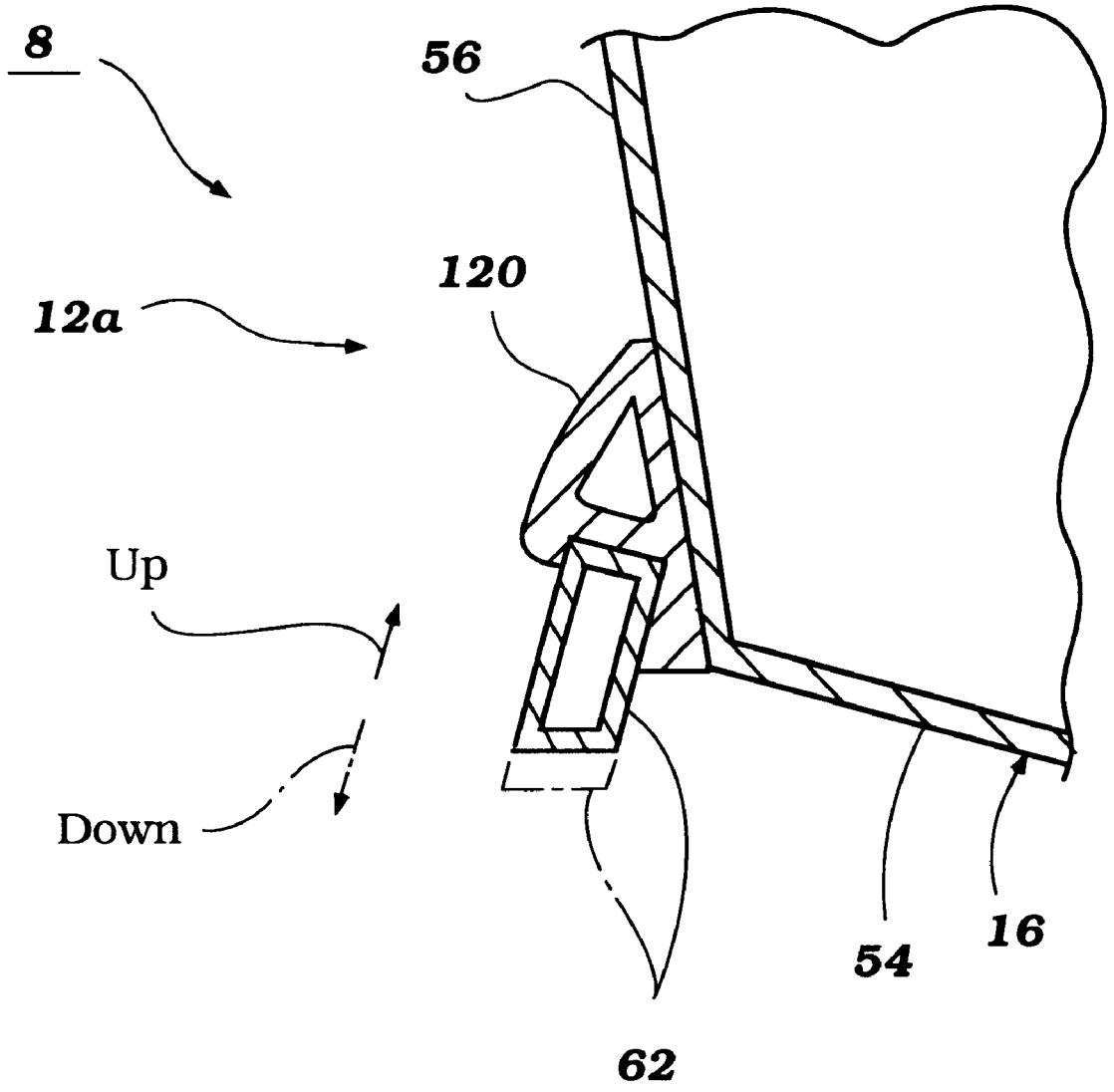
FIG. 17 is an enlarged cross-sectional view of the adjustable sponson module of FIG. 16 taken along line 17—17.

FIGS. 16 and 17 illustrate an additional embodiment of the base 120 and sponson 62 assembly and the associated actuator mechanism 84 which can be used with the present embodiment of the adjustable sponson system 8. The base 120 is again externally mounted to the side of the watercraft hull 16 and supports the sponson 16. The sponson 16 is coupled to the base 120 and rides within a slot which defines the corresponding travel path of the sponson 62. The slot is oriented so as to guide the sponson forwardly and upwardly or rearwardly and downwardly between a fully raised position and a fully lowered position.

A linear actuator 170 moves the sponson 62 relative to the base 120. In the illustrated embodiment, the linear actuator 170 includes an electric motor (e.g., stepper motor) which moves the sponson 62 relative to the base 120 in response to control instructions received from the operator via the electronic control unit 102. The linear actuator 170 desirably lies parallel to the sponson 62 and is linked thereto by a lever 172. Accordingly, linear movement of the actuator arm 174 moves the sponson 62 in a corresponding direction and to a corresponding degree.

Figure 18:
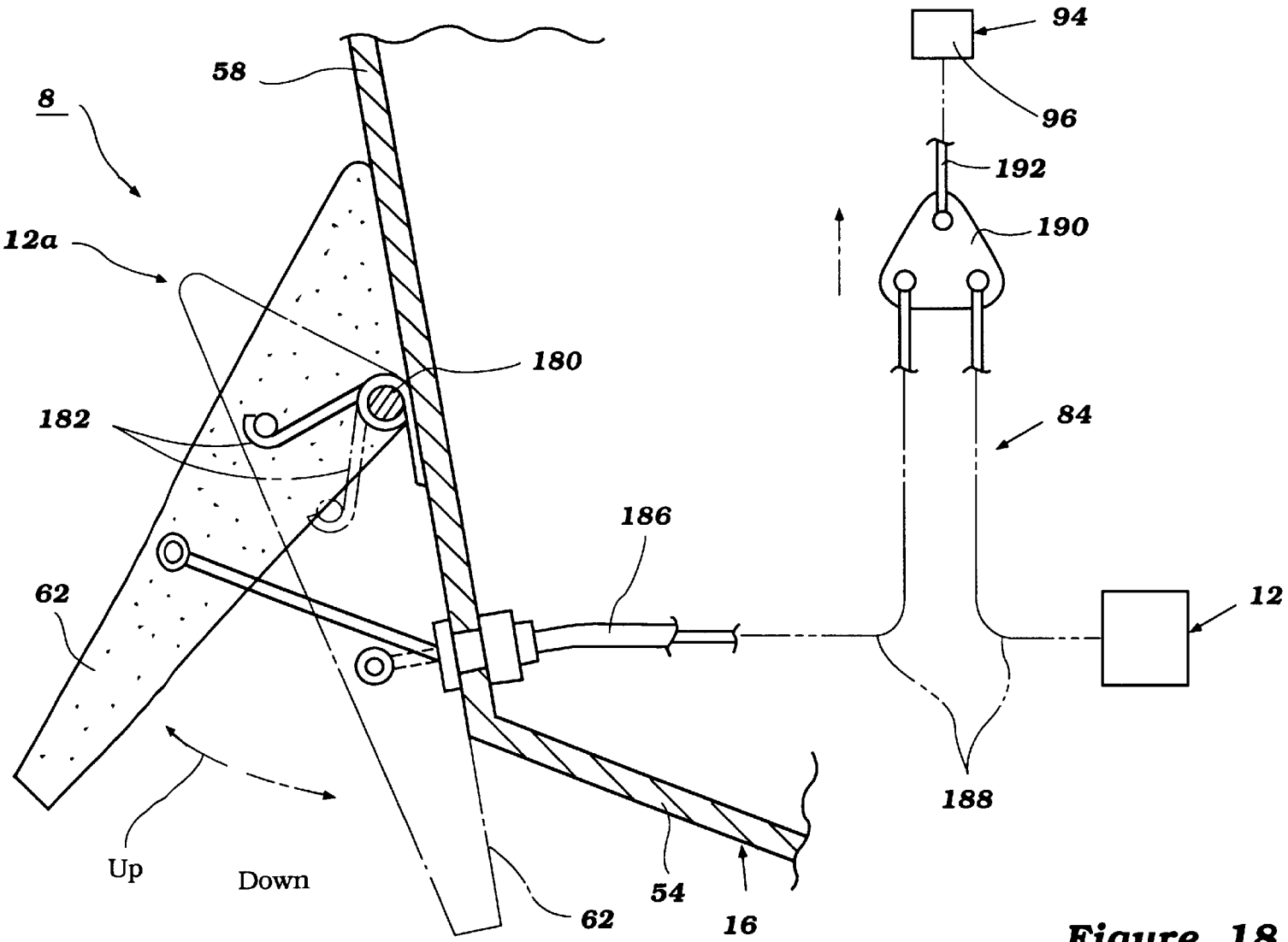
FIG. 18 is a schematic view of an adjustable sponson system configured in accordance with another embodiment of the present invention and illustrates a port-side sponson in cross-section.
Figure 19:
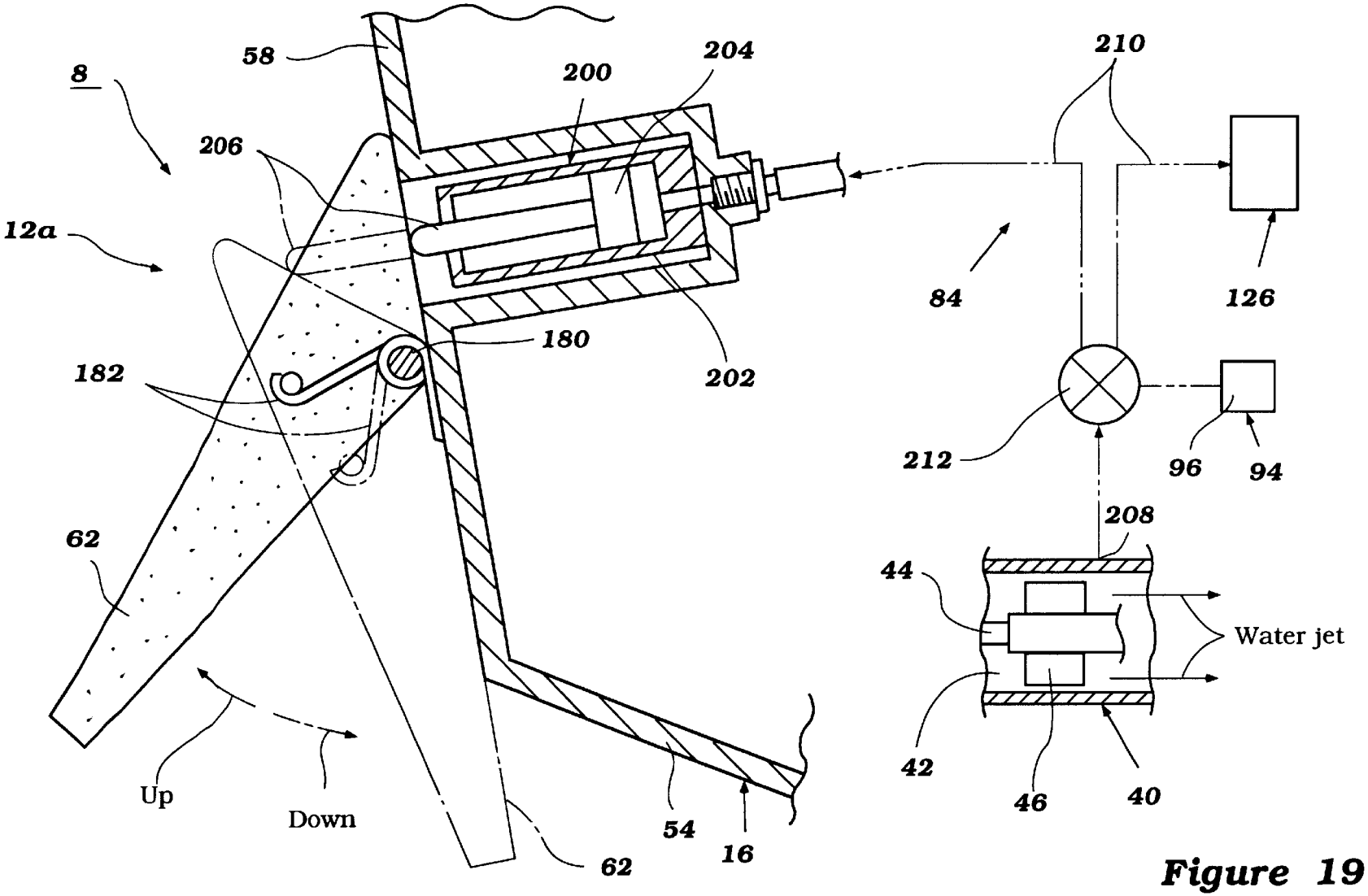
FIG. 19 is a schematic view of an adjustable sponson system configured in accordance with an additional embodiment of the present invention and illustrates a port-side sponson in cross-section.
Figure 20:
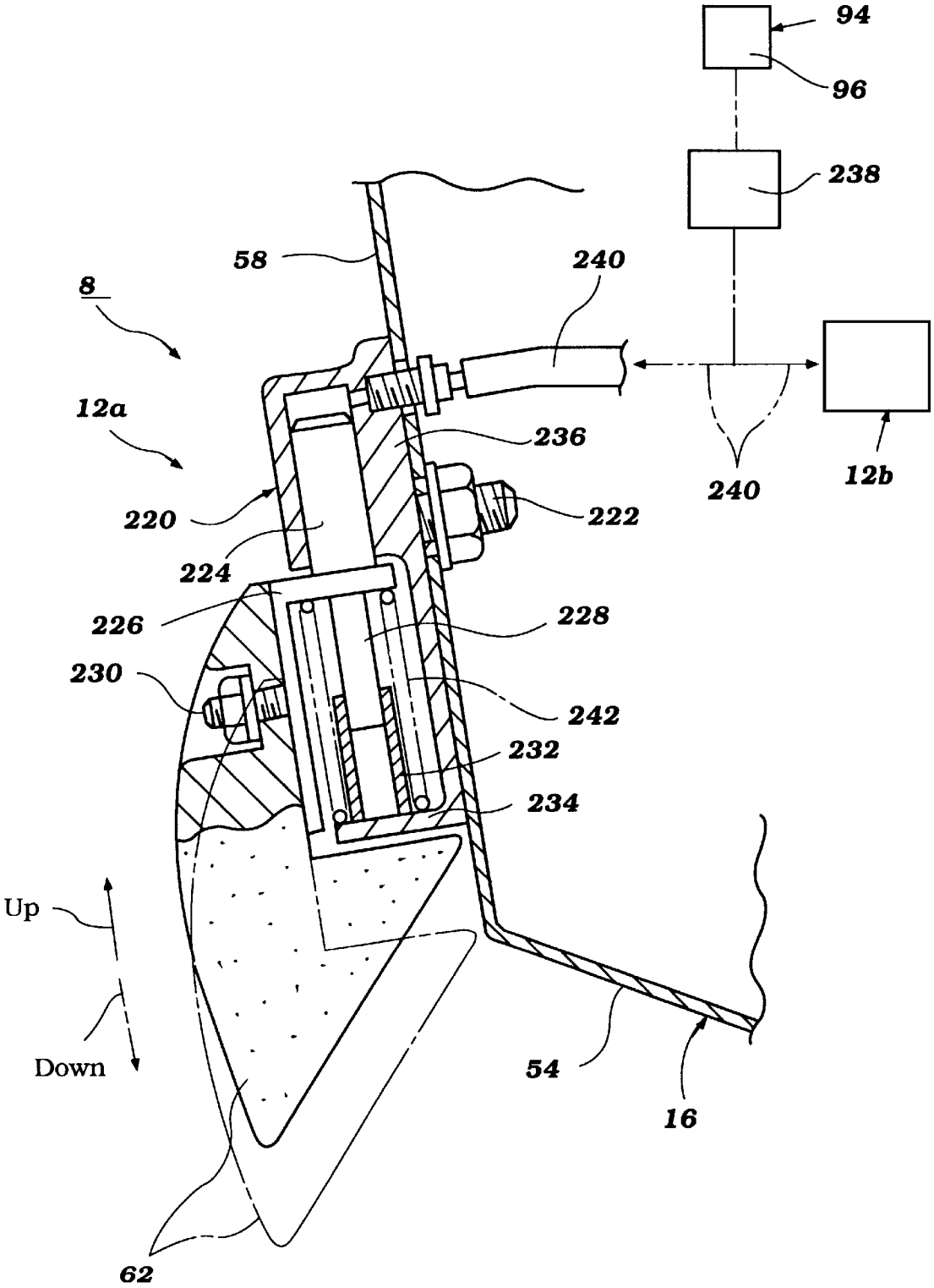
FIG. 20 is a schematic view of an adjustable sponson system configured in accordance with another embodiment of the present invention and illustrates a port-side sponson in cross-section.

FIGS. 18, 19 and 20 illustrate several additional embodiments of the adjustable sponson system which also includes a motion absorbing device. The motor absorbing device permits movement of the sponson relative to the hull without transmitting that motion to the operator; however, movement of the operator is directly transmitted to the sponson.

In the embodiment illustrated in FIG. 18, the sponson body 62 is supported by a pivot shaft 180 which is secured to the side wall 58 of the watercraft hull 16. The pivot shaft 180 desirably is supported thereon by a support base or similar lugs (not shown).

In the illustrated embodiment, the sponson 62 has a generally triangular cross sectional shape. The pivot shaft 180 extends through the sponson body 62 at a location near the intersection of two inner sides of the sponson 62. The sponson 62 thus rotates relative to the pivot shaft 180 between a fully extended position, at which an upper inner side of the sponson body 62 contacts the side wall 58 of the hull 16, and a fully retracted position at which a lower inner surface of the sponson body 62 contacts the side wall 58.

In the illustrated embodiment, a torsion spring 182 biases the sponson body 62 to the fully extended position. For this purpose, the torsion spring 182 operates between the sponson body 62 and the side wall 58 of the hull with one end of the torsion spring 182 coupled to the sponson body 62 and the other end cooperating with the hull side wall 58.

In the illustrated embodiment, the actuator 84 comprises a borden wire cable 186 which extends between the remote operator 94 and the sponson 62. An inner cable 188 is connected to the sponson body 62 and to a common fitting 190. The fitting 190 in turn is coupled to the operator 94 by a second borden wire cable 192. Movement of the operator 94 thus is directly imparted to the sponson body 62 to move the sponson body 62 between the fully extended position and the fully retracted position. In addition, the present embodiment employs a single operator 94 to simultaneously control both sponsons 12. The parallel nature of the actuator mechanisms 84 associated with the sponsons 12 promotes similar and simultaneous movement of both sponson upon movement of the operator 84.

The flexible nature of the cable system 186, however, forms the motion absorbing mechanism of this embodiment. That is, the borden wire cables 186 in combination with the torsion spring 182 directly transmit movement of the operator 94 to the sponsons 62. However, under some operating conditions, such as when turning, external forces on the sponson 62 may force the sponson 62 toward the side wall 58 of the watercraft 10 so as to reduce the profile of the sponson 12. This motion, however, is not directly transmitted to the operator 94 due to the flexible nature of the cable 186. Once the external force is removed, such as when the watercraft comes out of its turn, the spring force again biases the sponson 62 outwardly to remove the slack within the cable 186.

In the embodiment illustrated in FIG. 19, a hydraulic actuator 200 is used to move the sponsons 62 between the respective raised and lowered positions. The actuator 200 is housed within a recess 202 formed within the side wall 58 of the hull 16. The actuator 200 includes a cylinder in which a piston 204 slides. An actuator arm 206 is attached to the piston 204 and projects outwardly from the cylinder. The actuator arm 206 cooperates with the upper inner surface of the sponson 62 which lies above the pivot shaft 180. Movement of the arm 206 outwardly forces the sponson 62 to rotate downwardly above the pivot shaft 180 and against the force of the spring 182. The actuator arm 206 desirably has a rounded end so as to slide smoothly over the inner surface of the sponson 62.

Pressurized water from the jet pump unit 40 of the watercraft 10 desirably provides the working fluid within the hydraulic cylinder 200. For this purpose, the jet pump unit 40 includes a port 208 located downstream of the impeller 46. The port receives water from the jet pump unit and delivers the pressurized water to the hydraulic cylinder 200 through a delivery conduit 210. In the illustrated embodiment, the delivery conduit 210 includes a branch to deliver the working fluid (e.g., the pressurized water) to the hydraulic cylinders 200 of both the port side and the starboard side sponsons 12.

The adjustable sponson system 8 also desirably includes a solenoid-operated valve 212 which selectively places either one or both of the hydraulic cylinders 200 of the port and starboard side modules 12*a*, 12*b* in communication with the water inlet port 208. The remote operator 94 desirably controls the solenoid valve 212 via the electronic control unit 102 in the manner described above.

The hydraulic system also provides the motion absorbing mechanism of the present invention. Outward force on the sponson will compress the piston 204 if the applied force (and biasing force of the torsion spring) is greater than the hydraulic force applied by the pressurized water. This relative motion, however, is not transmitted back to the operator. Upon removal of the force, the pressurized water will again force the sponson to return to its described position.

FIG. 20 illustrated another embodiment employing a hydraulic actuating mechanism. In this embodiment, however, a closed loop hydraulic system is used rather than using pressurized water from the jet pump unit, as disclosed in connection with the embodiment of FIG. 19. In this embodiment, a linear hydraulic cylinder 220 is affixed to the side 58 of the hull 14 by at least one fastener 222. The cylinders 220 are arranged such that the corresponding piston 224 actuates along a stroke axis which is generally parallel to the side 58 of the watercraft hull 14. A piston 220 is affixed to a support bracket 226 and to a guide pin 228. The support bracket is coupled to the sponson 62 by one or more fasteners 230. The guide pin 228 cooperates with a sleeve 232. In the illustrated embodiment, the sleeve 232 is supported by a flange 234 of a base 236 that lies generally normal to the surface of the hull side wall 58. The flange 234 and base are desirably integrally formed with the cylinder 220 so as to be attached to the hull by the fastener 222.

A conventional hydraulic circuit 238 is used to actuate the piston 224. The hydraulic circuit 238 includes a reversible positive displacement fluid pump that is selectively driven in opposite directions by an electric motor (not shown). The pump can have a pair of ports either of which can function as a pressure port with the other function as a suction port, depending on the direction of rotation of the motor and the pump. Fluid delivery lines 240 connect the pump to the actuator 220. Conventional make up lines (not shown) can act upon to a hydraulic fluid reservoir (not shown) to provide make up fluid if required, as known in the art. In addition, a compression spring 242 desirably operates between the flange 234 and the bracket 226 so as to bias the piston 224 in a retracted position.

The remote operator 94 controls the hydraulic circuit 238 and cylinder 220 via the control unit 102 in the manner described above. That is, movement of the operator 96 produces a corresponding control signal which the control unit 102 receives. The control unit 102 in turn operates the electric motor of the positive displacement pump to either deliver or withdraw working fluid from the cylinder. When the hydraulic fluid is pressurized within the cylinder, the piston 224 moves downward to lower the sponson 62. The end of the piston stroke desirably is defined by the upper end of the sleeve. That is, when the piston is fully extended, the bracket contacts the upper end of the sleeve to prevent further movement of the piston within the cylinder. In this position, the sponson is in its lower most position. To raise the sponson 62, hydraulic fluid is forced out of the cylinder either under the motivation of the hydraulic circuit 238 and/or the compression spring 242.

The actuator of the present embodiment also provides a motion absorbing mechanism in the form of the compression spring (and/or the hydraulic circuit). For instance, when the watercraft is turned, the degree by which the inside sponson is raised (i.e., the sponson on the side to which the watercraft is turned) is reduced since it receives large water resistance. However, upon completion of the turn, the biasing force provided by the compression spring forces the sponson to return to its adjusted position. Likewise, the hydraulic circuit can include a motion absorbing mechanism to provide a similar effect.

Accordingly, although this invention has been described in terms of certain preferred embodiments, other embodiments apparent to those of ordinary skill in the art are also within the scope of this invention. The scope of the invention is intended to be defined only by the claims which follow.

What is claimed is:

1. A watercraft comprising an upper deck and a hull, said upper deck defining at least in part a rider's area at a location between first and second sections of the hull, and an adjustable sponson system including at least first and second sponsons, each of said first and second sponsons being movably attached to a respective one of said first and second side hull sections, at least one actuator coupled to each sponson to move the sponson relative to the respective hull section, and at least one operator coupled to the actuator to control the movement of at least one of the sponsons relative to the respective hull section, the operator being located near the rider's area on the upper deck.

2. A watercraft as in claim 1, wherein the operator is provided on a steering handle of the watercraft.

3. A watercraft as in claim 1, wherein the first and second sections of the hull form generally longitudinally extending side walls of the hull.

4. A watercraft as in claim 1, wherein said actuator includes an electric motor.

5. A watercraft as in claim 1, wherein said actuator includes a hydraulic cylinder.

6. A watercraft as in claim 1, wherein one actuator moves only one of the sponsons, and the operator is configured to control each of the actuators individually.

7. A watercraft as in claim 6, wherein a single control element of the operator operates both actuators.

8. A watercraft as in claim 1, wherein each sponson is movably attached to the watercraft hull by a guide mechanism that principally defines a travel path for at least a portion of said sponson over a surface of the respective hull section, said guide mechanism being arranged such that the respective sponson moves at least in part normal to a surface of the body of water in which the watercraft is operated.

9. A watercraft as in claim 1, wherein the adjustable sponson system includes at least one locking mechanism which selectively inhibits movement of at least one of the sponsons relative to the watercraft hull.

10. A watercraft comprising an upper deck and a hull, said upper deck defining at least in part a rider's area at a location between first and second sections of the hull, and an adjustable sponson system including at least first and second sponsons, each of said first and second sponsons being movably attached to a respective one of said first and second hull sections, and at least first and second actuators, each of said first and second actuators being coupled to a respective one of said first and second sponsons, said actuators being operable independent of each other, the adjustable sponson system including at least one operator positioned remote relative to the sponson, and said operator comprising dedicated control elements for each actuator.

11. A watercraft as in claim 10, wherein the control elements include at least a pair of switches arranged close to each other.

12. A watercraft as in claim 10, wherein the operator additionally comprises a single control element which is configured to simultaneously control both said first and second actuators.

13. A watercraft as in claim 10, wherein the operator is arranged on a steering handlebar assembly of the watercraft.

14. A watercraft as in claim 10, wherein each sponson comprises a sponson body and a base adapted to be mounted on the corresponding hull section, said sponson being movable attached to said base by a coupling mechanism, and said coupling mechanism includes a guide mechanism that principally defines a travel path for at least a portion of thy sponson body on the base.

15. A watercraft as in claim 10, wherein each sponson is movably attached to the watercraft hull by a guide mechanism that principally defines a travel path for at least a portion of said sponson over a surface of the respective hull section, said guide mechanism being arranged such that the respective sponson moves at least in part normal to a surface of the body of water in which the watercraft is operated.

16. A watercraft as in claim 10, wherein the adjustable sponson system includes at least first and second locking mechanisms, each locking mechanism being arranged between the respective actuator and sponson to selectively inhibit movement of the sponson relative to the respective watercraft hull section.

17. An adjustable sponson for use with a watercraft hull, said sponson comprising a sponson body and a sponson base, said sponson base being adapted to be mounted on an outer surface of the watercraft hull, said sponson body being moveably attached to said sponson base by a coupling mechanism, said sponson base having a surface that forms at least a portion of a exterior surface of said sponson, said coupling mechanism including a guide mechanism that at least partially defines a travel path for at least a portion of said sponson body on said sponson base.

18. An adjustable sponson as in claim 17, additionally including a drive mechanism operable at least in part between the base and the sponson body to move at least a portion of the body sponson along the travel path.

19. An adjustable sponson as in claim 18, wherein the drive mechanism includes an actuator.

20. An adjustable sponson as in claim 19, additionally comprising an operator which is configured to control said actuator, and said operator is adapted to be remotely positioned relative to said actuator.

21. An adjustable sponson as in claim 17, wherein said coupling mechanism additionally comprises a locking mechanism which selectively inhibits movement of at least a portion of the sponson body relative to the base.

22. A watercraft comprising a hull and an adjustable sponson system, said adjustable sponson system including at least one sponson movable attached to the hull, an operator coupled to the sponson and configured to control movement of the sponson relative to the hull, and an absorbing mechanism operable between the operator and the sponson, whereby the absorbing mechanism allows for movement of the sponson relative to the hull without communicating such movement to the operator.

23. A watercraft as in claim 22, wherein the absorbing mechanism comprises a lost motion coupling and a biasing mechanism.

24. A watercraft as in claim 22, additionally comprising an actuator coupled to the sponson so as to move the sponson relative to the hull and connected to the operator so as to be controlled by said operator, and said absorbing mechanism being integrated into said actuator.

25. An adjustable sponson for use with a watercraft hull having a longitudinal axis that extends in a fore and aft direction of said hull, said sponson comprising a sponson body and a mounting shaft, said mounting shaft being adapted to be mounted on an outer surface of said hull, said sponson body being pivotably attached to said hull with said mounting shaft defining a pivot axis for said sponson body, said pivot axis extending in a generally longitudinal direction such that said sponson body is pivotable about pivot axis between at least two positions.

26. An adjustable sponson as in claim 25, additionally including a drive mechanism operable between at least a portion of said sponson body to move at least a portion of said sponson body about said pivot axis.

27. An adjustable sponson as in claim 26, wherein said drive mechanism includes an actuator.

28. An adjustable sponson as in claim 27, additionally comprising an operator which is configured to control said actuator, and said operator is adapted to be remotely positioned relative to said actuator.

29. An adjustable sponson as in claim 25, wherein said sponson additionally comprises a locking mechanism that selectively inhibits movement of at least a portion of said sponson body relative to said pivot axis.

* * * * *